US006334675B1

(12) United States Patent
Sanada et al.

(10) Patent No.: US 6,334,675 B1
(45) Date of Patent: Jan. 1, 2002

(54) IMAGE FORMING APPARATUS

(75) Inventors: Kazuo Sanada; Tsutomu Takatsuka, both of Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/372,606

(22) Filed: Aug. 12, 1999

(30) Foreign Application Priority Data

Aug. 31, 1998 (JP) ..... 10-245671

(51) Int. Cl.[7] ..... B41J 2/17
(52) U.S. Cl. ..... 347/95; 347/32; 347/84
(58) Field of Search ..... 347/95, 28, 32, 347/33, 44, 37, 84; 396/604, 606

(56) References Cited

U.S. PATENT DOCUMENTS 5,960,224 A * 9/1999 Sanada et al. ..... 396/604
5,988,787 A * 11/1999 Watanabe et al. ..... 347/22
6,010,254 A * 1/2000 Sanada ..... 347/95
6,196,653 B1 * 3/2001 Igarashi et al. ..... 347/23

* cited by examiner

*Primary Examiner*—John Barlow
*Assistant Examiner*—Manish S. Shah
(74) *Attorney, Agent, or Firm*—Sughrue Mion, PLLC

(57) ABSTRACT

A jetting device of an image forming apparatus is disposed so as to face a transporting path for an image recording material, and jets an image-forming solvent towards the image recording material. A position of the jetting device is changed in accordance with a state of the jetting device, by a position-controlling mechanism, which is inside the image forming apparatus. The position-controlling mechanism is structured by a plurality of gears which, with an arm that supports the jetting device and rotates, changes the position of the jetting device together with rotation of the jetting device. A sealing- and cleaning-member of the image forming apparatus seals a jetting surface of the image forming apparatus, which surface jets the image-forming solvent, and cleans the jetting surface, in a non-jetting state in which the image-forming solvent is not jetted. Accordingly, the image-forming solvent can be reliably jetted when necessary, and the image recording material can be easily removed when jammed at the transporting path during conveyance.

20 Claims, 17 Drawing Sheets

IMAGE FORMING APPARATUS

BACKGROUND OF THE INVENTION

1. Field of the Invention

The present invention relates to an image forming apparatus that can appropriately jet a solvent for image formation onto an image recording material such as a photosensitive material, an image-receiving material, and the like.

2. Description of the Related Art

An image forming apparatus is known which carries out image recording processing using two types of image recording materials, for example, a photosensitive material and an image-receiving material.

Within an image forming apparatus of this type, an image-forming solvent application section for image formation and a thermal development transfer section are disposed. The image-forming solvent application section has a vat storing therein an image-formation solvent to be applied onto a photosensitive material. The thermal development transfer section is comprised of an endless pressure belt which presses against a heating drum and a periphery of this heating drum, and which rotates together with the heating drum.

The photosensitive material, in which an image is developed while the photosensitive material is conveyed in an interposed state within the image forming apparatus, is immersed in the vat in which water as the image-formation solvent is stored in the image-forming solvent application section. After water is applied to the photosensitive material, the photosensitive material is sent into the thermal development transfer section. The image-receiving material is sent into the thermal development transfer section in the same way as the photosensitive material.

In the thermal development transfer section, the photosensitive material that has been subjected to water application and the image-receiving material are layered together, and in this state, are wound onto the outer periphery of the heating drum. Further, both materials are conveyed in an interposed state between the heating drum and the endless pressure belt. As the photosensitive material is thermally developed, the image is transferred to the image-receiving material, and a prescribed image is formed on the image-receiving material (recorded).

However, in cases in which the photosensitive material is immersed into the vat storing water as the image-formation solvent and water is applied thereto, water that at one time contacted the photosensitive material is regularly maintained in the vat. As a result, small amounts of organic substances eluted from the photosensitive material function as a source of nutrition for bacteria, bacteria thereby propagate within the vat, and the water becomes contaminated. There is a fear that the contaminated water may cause deterioration in the image forming apparatus itself, as well as in image quality.

Accordingly, the following may be considered: preventing the photosensitive material from contacting the water in the vat or the like used for supply purposes, vibrating a nozzle plate having nozzle holes, and applying small water droplets to the photosensitive material by jetting the water droplets with a jetting device.

However, in the case of a jetting device that jets water droplets onto the photosensitive material that has been conveyed, there is a fear that water may leak out inadvertently from the jetting device. There is also a fear of it becoming impossible to jet the water towards the photosensitive material due to air remaining within the jetting device when the water begins to be charged into the jetting device, which results in the water pressure within the jetting device not reaching a sufficiently high level.

Further, since the clearance between the jetting device and the photosensitive material is minimized in order to apply the water to the photosensitive material evenly, when the photosensitive material becomes jammed at a portion of a transporting path facing the jetting device, removing the jammed photosensitive material from the transporting path is difficult.

SUMMARY OF THE INVENTION

The present invention has been devised in consideration of the above circumstances. An object of the present invention is to obtain an image formation apparatus that prevents an image-formation solvent from leading out inadvertently, enables reliable jetting of the image-formation solvent, and further, allows a photosensitive material that has become jammed in a transporting path to be easily removable.

A first aspect of the present invention comprises: a jetting device which is disposed so as to face a transporting path for an image recording material and which jets an image-forming solvent towards the image recording material, and a position-controlling mechanism which changes a position of the jetting device in correspondence with a state of the jetting device.

A second aspect of the present invention comprises: a jetting device which is disposed so as to face a transporting path for an image recording material and which can jet an image-forming solvent towards the image recording material; an arm which supports the jetting device and which swings to rotate the jetting device; a first gear having teeth arranged along an arc having as a center thereof a swinging center point of the arm; a second gear which is fixed at the jetting device so as to mesh with the first gear, and which changes a position and orientation of the jetting device in conjunction with rotation of the jetting device; and a driving mechanism which swings the arm.

A third aspect of the present invention comprises: a jetting device which is disposed so as to face a transporting path for an image recording material and which can jet an image-forming solvent towards the image recording material; a position-controlling mechanism which changes a position of the jetting device in correspondence with a state of the jetting device; and a sealing- and cleaning-member which seals a jetting surface of the jetting device, which surface jets the image-forming solvent, and which cleans the jetting surface, in a non-jetting state without jetting of the image-forming solvent.

Herein, "position" refers to the location and or the orientation.

Operation of an image forming apparatus according to the first aspect of the present invention will be explained below.

The jetting device, which is disposed so as to face the transporting path for the image recording material, jets the image-forming solvent towards the image recording material.

Further, the position-controlling mechanism changes the position of the jetting device in accordance with each of the following states: a standby state during the period until the image-forming solvent is jetted onto the image recording material; a charging-start state in which charging of the image-forming solvent into the jetting device is begun; a jetting state in which the image-forming solvent inside the jetting device is jetted toward the image recording material; a cleaning state in which a jetting surface of the jetting device, which surface jets the image-forming solvent, is cleaned, and the like.

Since the position-controlling mechanism can change the position of the jetting device in accordance with each of the states of the jetting device, when the image-forming solvent begins to be charged, the position of the jetting device is changed so as to incline the jetting device, and the air remaining inside the jetting device is removed. Further, by changing the position of the jetting device to a position where a cleaning member is present, for example, a jetting surface of the jetting device can be easily cleaned. As a result, the image-forming solvent can be jetted towards the image recording material reliably whenever necessary.

Further, by changing the position of the jetting device to a position where a cap is present, for example, the image-forming solvent can be prevented from inadvertently spilling or evaporating from the jetting device.

Further, since changing the position of the jetting device has been made possible, the image recording apparatus can be easily removed when becoming jammed during conveyance at a portion of the transporting path facing the jetting device.

Operation of the second aspect according to the present invention will be explained below.

The jetting device, which is disposed so as to face the transporting path for the image recording material, jets the image-forming solvent towards the image recording material.

Further, the jetting device rotates in conjunction with the arm supporting the jetting device being swung by the driving mechanism. At this time, the jetting device is rotated while the first gear, whose teeth are arranged along an arc having the swinging center point of the arm as a center, and the second gear, which is fixed to the jetting device, mesh together, and the jetting device rotates in correspondence with swinging of the arm. The position of the jetting device is thereby changed.

Accordingly, since the position of the jetting device can be changed, not only can the image-forming solvent be jetted towards the image recording material reliably whenever necessary and the image-forming solvent be prevented from inadvertently, but the image recording material can be easily removed when becoming jammed at a portion of the transporting path facing the jetting device, as in the first aspect.

Operation of the image forming apparatus according to the third aspect of the present invention will be explained below.

The jetting device, which is disposed so as to face the transporting path for the photosensitive material, jets the image-forming solvent towards the image recording material.

Further, the position-controlling mechanism can change the position of the jetting device in the same way as in the first aspect, in accordance with a standby state, a charging-start state, a jetting state, a cleaning state, and the like.

Accordingly, since the position of the jetting device is changed, not only can the image-forming solvent be jetted towards the image recording material reliably whenever necessary and the image-forming solvent be prevented from inadvertently, but the image recording material can be easily removed when becoming jammed at a portion of the transporting path facing the jetting device, as in the first aspect.

Further, when the position of the jetting device is changed from the jetting state, in which the image-forming solvent is jetted towards the image recording material, to a non-jetting state, in which the image-forming solvent is not jetted, the sealing- and cleaning-member seals the jetting surface of the jetting device, which surface jets the image-forming solvent, and can clean the jetting surface.

Accordingly, not only is operation as in the first aspect performed, but since the sealing- and cleaning-member makes possible sealing of the jetting surface of the jetting device, which surface jets the image-receiving material, and cleans the jetting surface, the number of components of the image forming apparatus can be reduced.

DESCRIPTION OF THE PREFERRED EMBODIMENT

Figure 1:
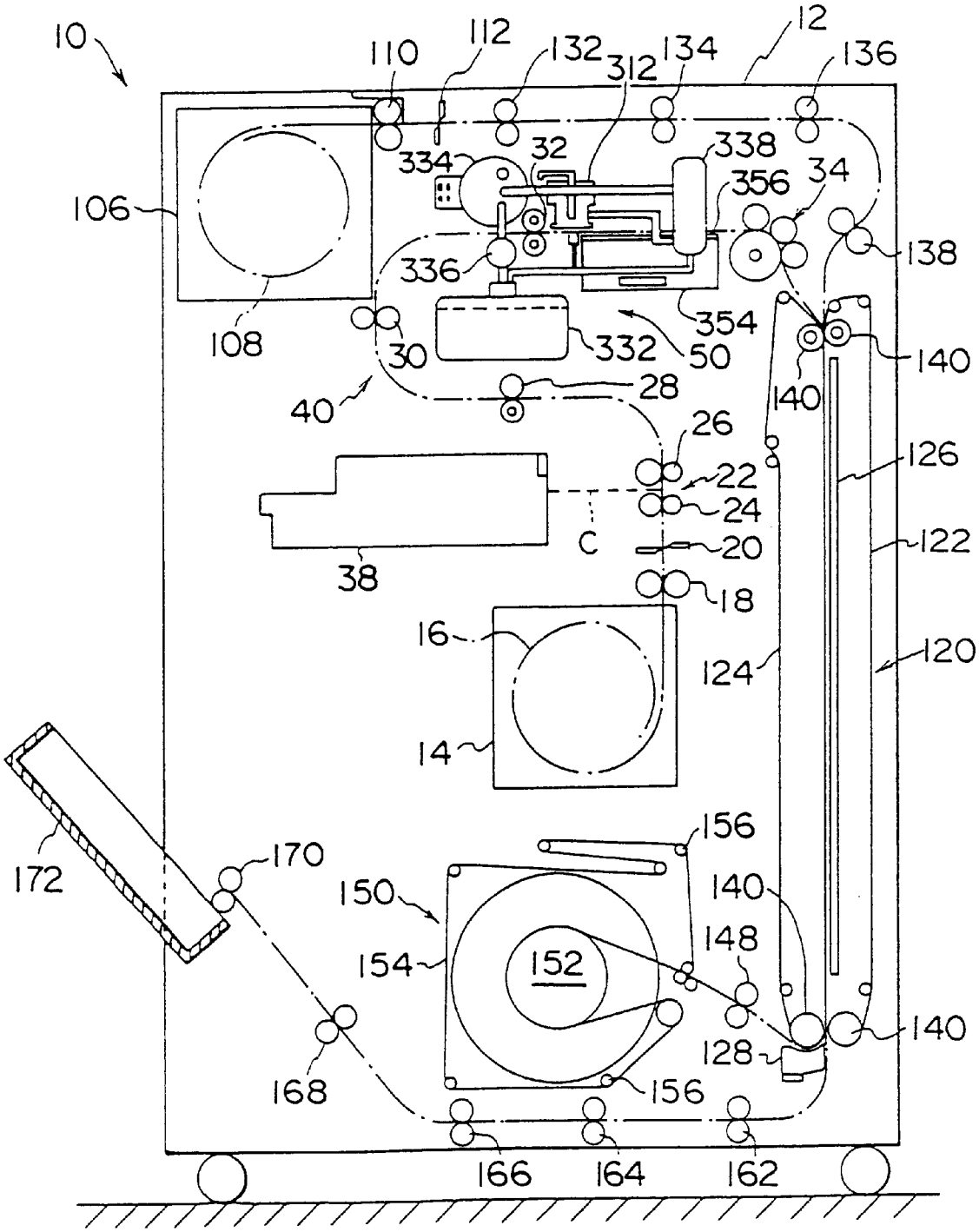
FIG. 1 is a schematic total structural view of an image recording apparatus according to an embodiment of the present invention.

FIG. 1 is a schematic total structural view of an image recording apparatus 10 that is an image forming apparatus according to an embodiment of the present invention. A photosensitive material magazine 14 which accommodates a photosensitive material 16 is disposed inside a mount 12 of the image recording apparatus 10. The photosensitive material 16 is wound in a roll configuration in the photosensitive material magazine 14 so that a photosensitive (exposure) surface of the photosensitive material 16 faces left when the photosensitive material 16 is pulled out from the photosensitive material magazine 14.

Nip rollers 18 and a cutter 20 are disposed in the vicinity of a photosensitive material pull-out opening of the photosensitive material magazine 14. The photosensitive material 16 can be cut after being pulled out from the photosensitive material magazine 14 a predetermined length. The cutter 20 is, for example, a circular-type cutter comprised of a fixed blade and a movable blade, and can cut the photosensitive material 16 by moving the movable blade with a rotary cam or the like so as to engage with the fixed blade.

A plurality of conveying rollers 24, 26, 28, 30, 32, 34 are disposed in sequence downstream of the cutter 20 in the direction the photosensitive material 16 is conveyed. Between each of the conveying rollers, a guide plate, which is not illustrated in FIG. 1, is provided. The photosensitive material 16 which has been cut into a predetermined length is conveyed first to an exposing section 22 provided between the conveying rollers 24 and 26.

An exposure device 38 is provided to the left of the exposing section 22. Three types of optical disks, a lens unit, a polygon mirror, and a mirror unit (all of which are not illustrated) are disposed at the exposure device 38. A light beam C is sent to the exposing section 22 from the exposure device 38, and the photosensitive material 16 is thereby exposed at the exposing section 22.

Further, at an upper side of the exposing section 22, a U-turn section 40 for conveying the photosensitive material 16 while curving the photosensitive material 16 in a U-shaped configuration, and a water application section 50 for applying an image-formation solvent are provided. Further, water is used as the image-formation solvent in an embodiment of the present invention.

The photosensitive material 16, which has ascended from the photosensitive material magazine 14 and which has been exposed at the exposing section 22, is conveyed into the water application section 50 by passing through a transporting path towards an upper side of the U-turn section 40 and being conveyed in an interposed state by the pairs of the conveying rollers 28 and 30.

Figure 2:
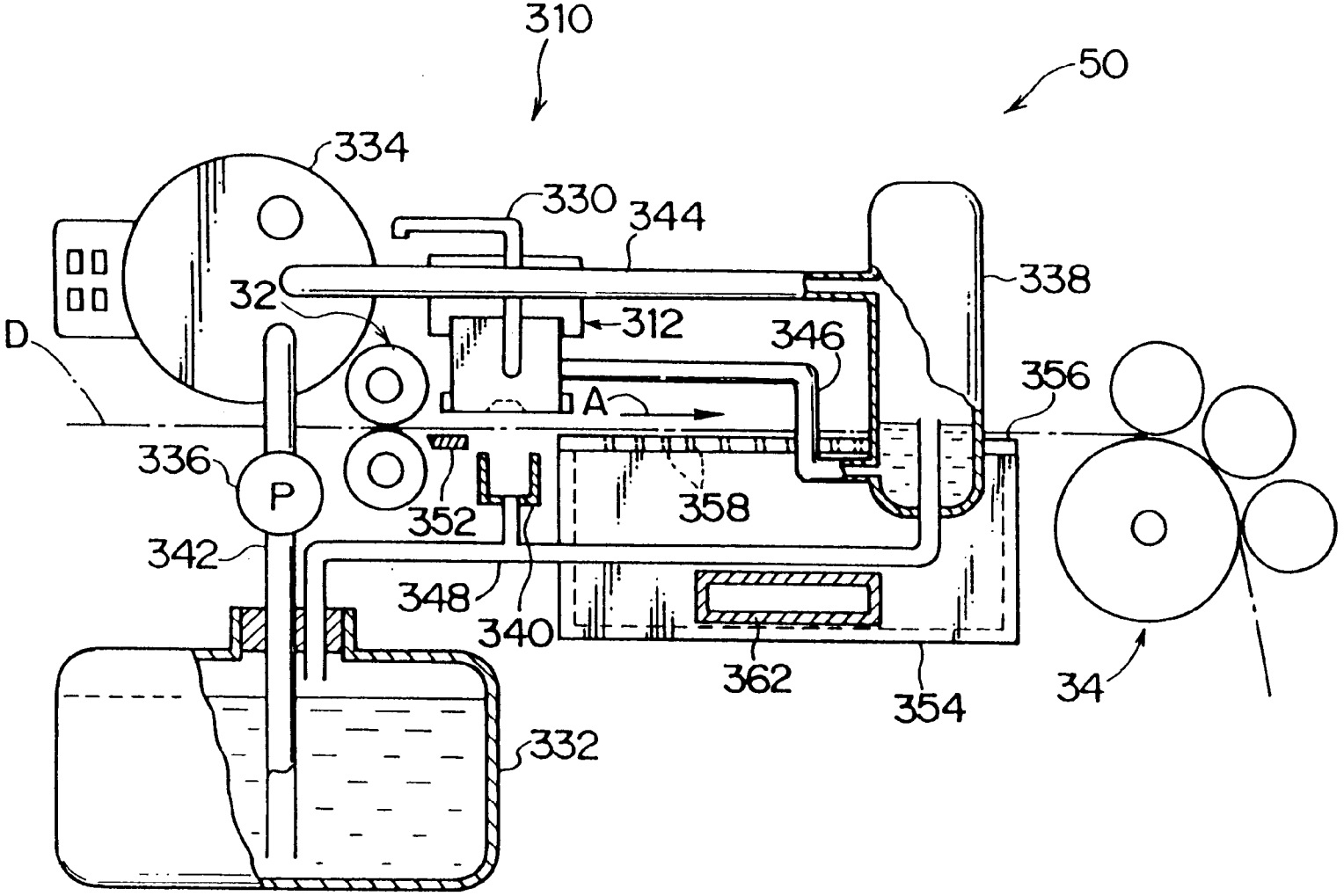
FIG. 2 a schematic total structural view of an application device according to the embodiment of the present invention (however, a position-controlling mechanism has been omitted from the Figure).

On the other hand, as illustrated in FIG. 2, a jetting tank 312 is disposed at a position that faces a transporting path D for the photosensitive material 16, which transporting path D is in the water application section 50. The jetting tank 312 is a jetting mechanism that forms a portion of an application device 310, which is a liquid jetting device.

Further, as illustrated in FIG. 2, a water bottle 332 is disposed at a lower left side of the jetting tank 312. The water bottle 332 is for storing water to be supplied to the jetting tank 312. At an upper portion of the water bottle 332, a filter 334 is disposed, for filtering water. A water-conveyance pipe 342, which is provided with a pump 336 at an intermediate portion thereof, connects the water bottle 332 and the filter 334.

Further, at a right side of the jetting tank 312, a sub-tank 338 is disposed. The sub-tank 338 is for storing water conveyed from the water bottle 332. A water-conveyance pipe 344 extends from the filter 334 to the sub-tank 338.

Accordingly, when the pump 336 operates, water is sent from the water bottle 332 towards the filter 334, and water filtered by passing through the filter 334 is sent to the sub-tank 338, where the water is temporarily stored.

A water-conveyance pipe 346 is disposed between the sub-tank 338 and the side of one end of the jetting tank 312 so as to connect the two. The water conveyed due to the water bottle 332 and the pump 336 via the filter 334, the sub-tank 338, and the water-conveyance pipe 346 eventually fills the inside of the jetting tank 312.

A tray 340 is disposed at the side of a lower portion of the jetting tank 312 in FIG. 2, namely, at the side of the transporting path D for the photosensitive material that is opposite the jetting tank 312. The tray 340 is formed in a channel form and is connected to the water bottle 332 by a circulation pipe 348. The tray 340 collects the water that spills over from the jetting tank 312, and returns the water to the water bottle 332 via the circulation pipe 348. Further, this circulation pipe 348 is connected to the sub-tank 338 in an extended state, by protruding inside the sub-tank 338. Excess water that has accumulated inside the sub-tank 338 is returned to the water bottle 332 via the circulation pipe 348.

Figure 15:
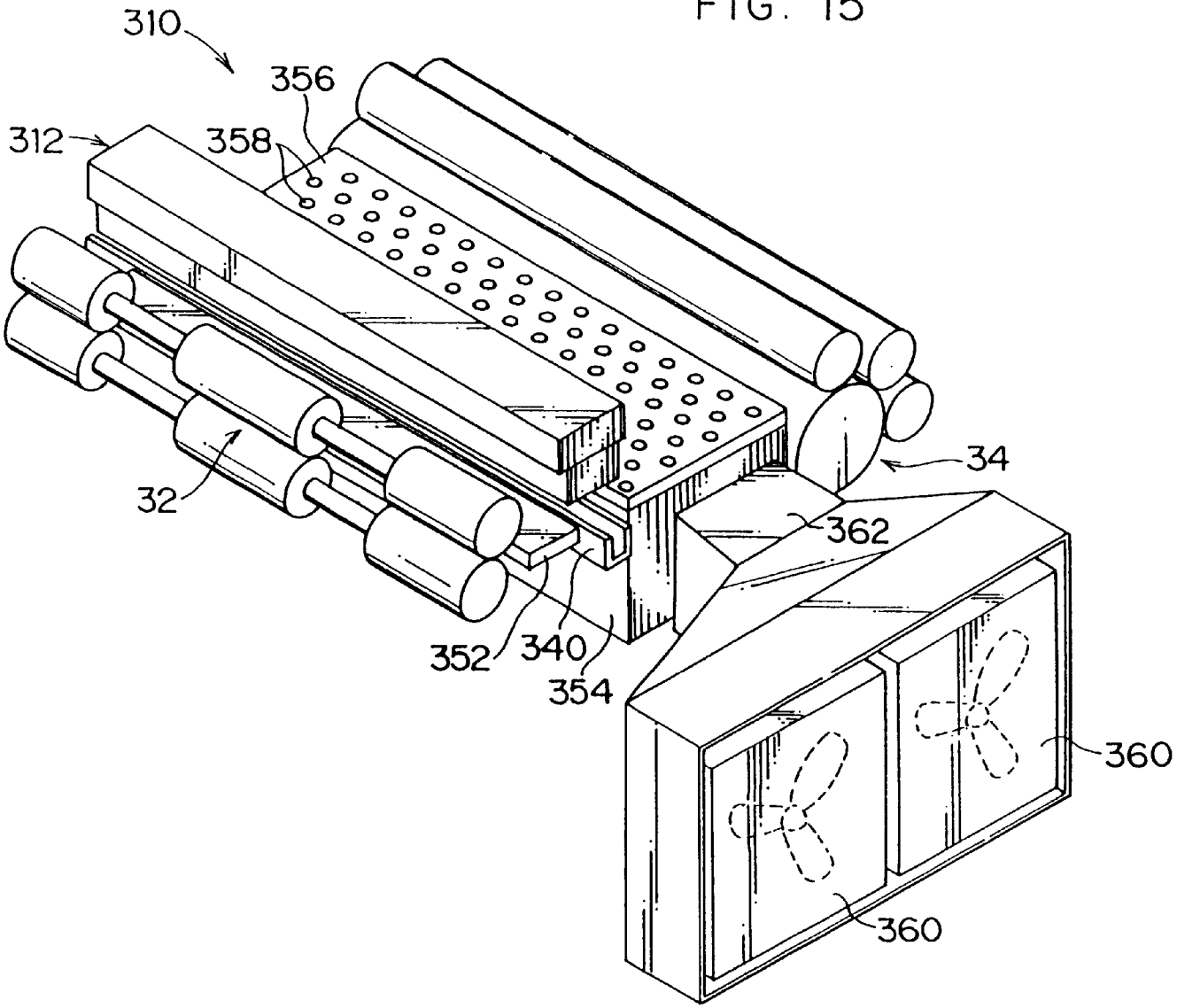
FIG. 15 is a perspective view of the application device in the embodiment according to the present invention (however, the position-controlling mechanism has been omitted from the Figure).

As illustrated in FIGS. 2 and 15, a guide plate 352 is set between the pair of the conveying rollers 32 and the jetting tank 312, at a side of the transporting path D opposite to the jetting tank 312. The guide plate 352 is for guiding, while supporting, the photosensitive material 16.

On the other hand, a chamber 354 is disposed at a position downstream of the jetting tank 312 in the direction the photosensitive material 16 is conveyed, at a side of the transporting path D for the photosensitive material 16, which side is opposite that of the jetting tank 312. The chamber 354 is of a box form, and a cavity is formed therein. A heating plate 356, which is a smooth flat plate containing a heater or the like (not shown), covers an upper portion of the chamber 354. This heating plate 356 is formed with a plurality of suction holes 358 at regular intervals, which extend from the inside of the chamber 354 completely to the outside.

As illustrated in FIG. 15, a pair of fans 360 are set at a side of one end of the chamber 354. The pair of the fans 360 are for drawing in air from the chamber 354. A duct 362 connects the fans 360 and the chamber 354.

Accordingly, by operating the fans 360, the air inside the chamber 354 is drawn in via the duct 362. In conjunction, the suction holes 358 of the heating plate 356 attract the non-application surface of the photosensitive material 16 (the lower surface in FIG. 2). The heating plate 356 thereby guides the photosensitive material 16 while heating it, on the transporting path D.

Further, at a side that is downstream of the transporting path D for the photosensitive material 16 with respect to the jetting tank 312 and the heating plate 356, the conveying rollers 34 comprised of a plurality of rollers are disposed. The conveying rollers 34 are for conveying the photosensitive material 16 after water has been jetted thereon.

Figure 11:
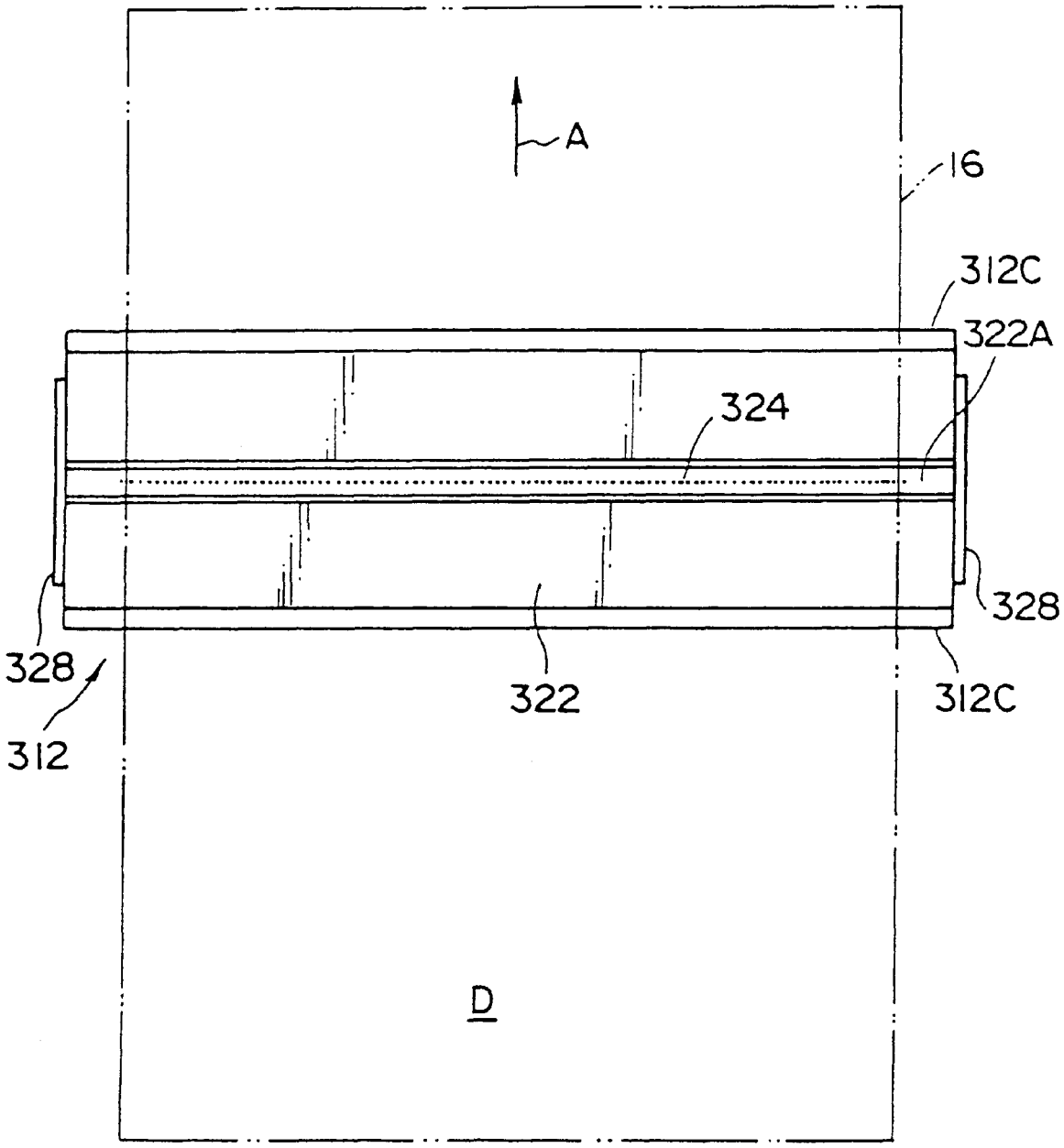
FIG. 11 is a bottom view illustrating a state in which a photosensitive material is being conveyed beneath the jetting tank in the embodiment according to the present invention (however, the position-controlling mechanism has been omitted from the Figure).
Figure 13:
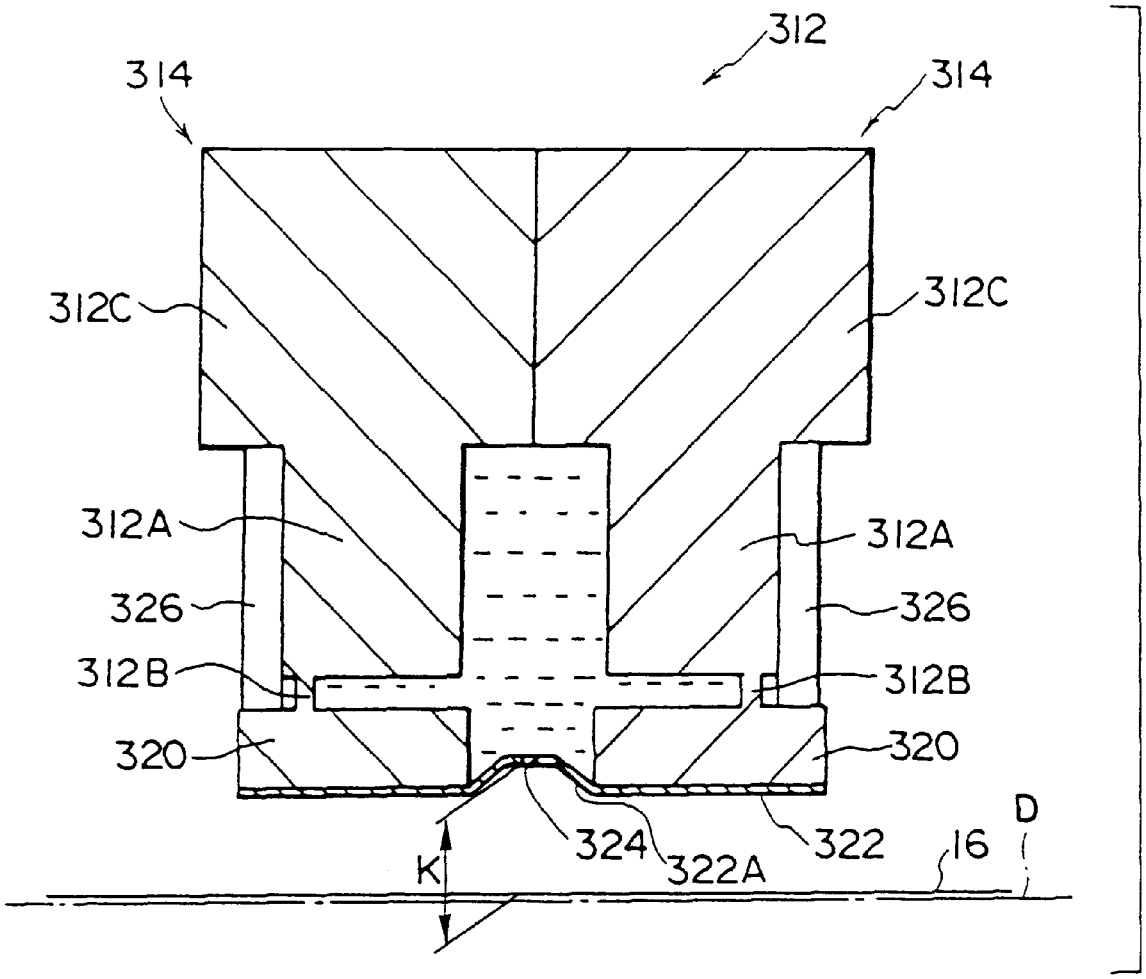
FIG. 13 is a cross-sectional view of the jetting tank in the embodiment according to the present invention.

On the other hand, as illustrated in FIGS. 11 and 13, a nozzle plate 322 is set at a portion facing the transporting path D for the photosensitive material 16, as a bottom wall surface which is one section among wall surfaces of the jetting tank 312. The nozzle plate 322 is formed with a thin, elastically deformable plate-shaped plate material of a rectangular configuration (for example, having a plate thickness of 60 μm or less).

Figure 12:
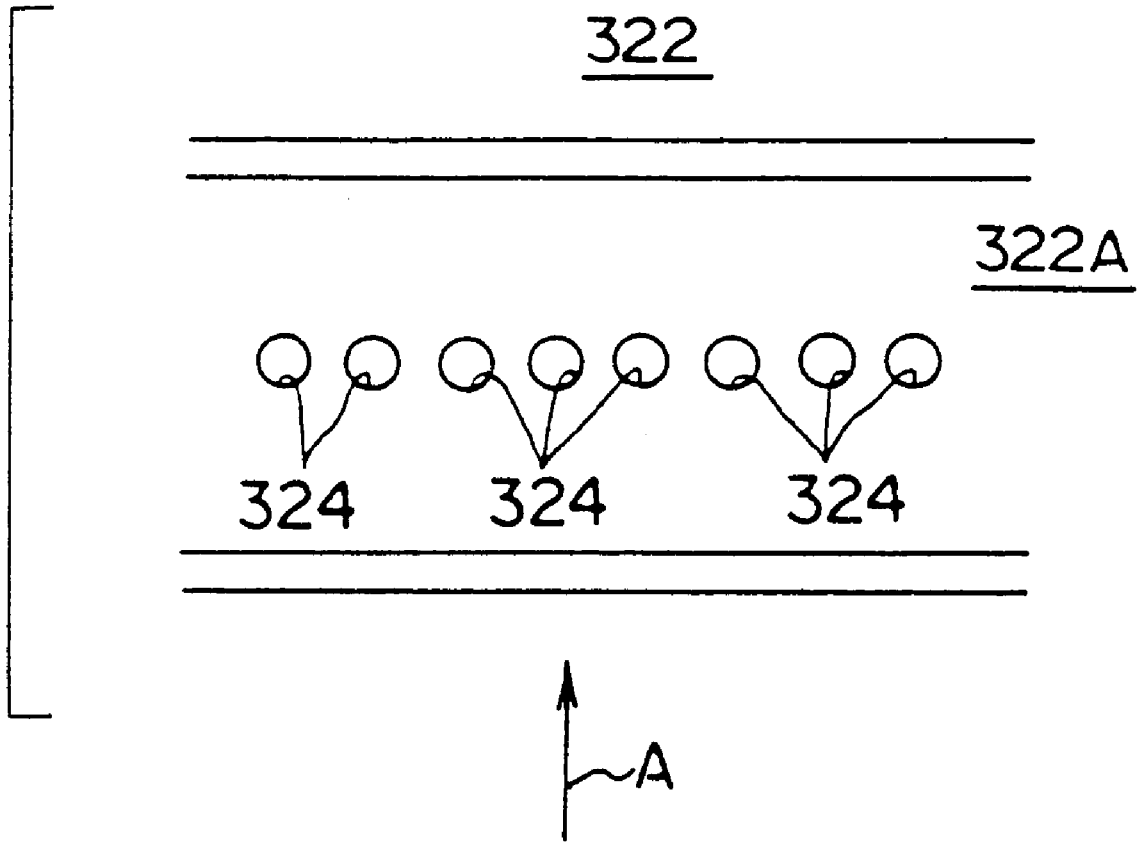
FIG. 12 an enlarged view of a main portion of FIG. 11.

As illustrated in FIGS. 11 and 12, a plurality of nozzle holes 324 arranged linearly along a direction intersecting the conveyance direction A for the photosensitive material 16 are disposed at regular intervals across the entire transverse direction of the photosensitive material 16 (for example, the nozzle holes may each have a diameter of 10 μm to 200 μm). The water with which the jetting tank 312 is filled can be expelled by being jetted from these nozzle holes 324 toward the photosensitive material 16. A portion of the nozzle plate 322 in which the plurality of nozzles holes 324 is formed is a jetting surface for jetting water of the jetting tank 312.

In order to increase the rigidity of the nozzle plate along the longitudinal direction thereof, which is the direction along which the plurality of nozzle holes 324 are arranged, a groove portion 322A is formed in a curved state. The groove portion 322A extends along the direction along which the plurality of nozzle holes 324 are arranged linearly.

Figure 4:
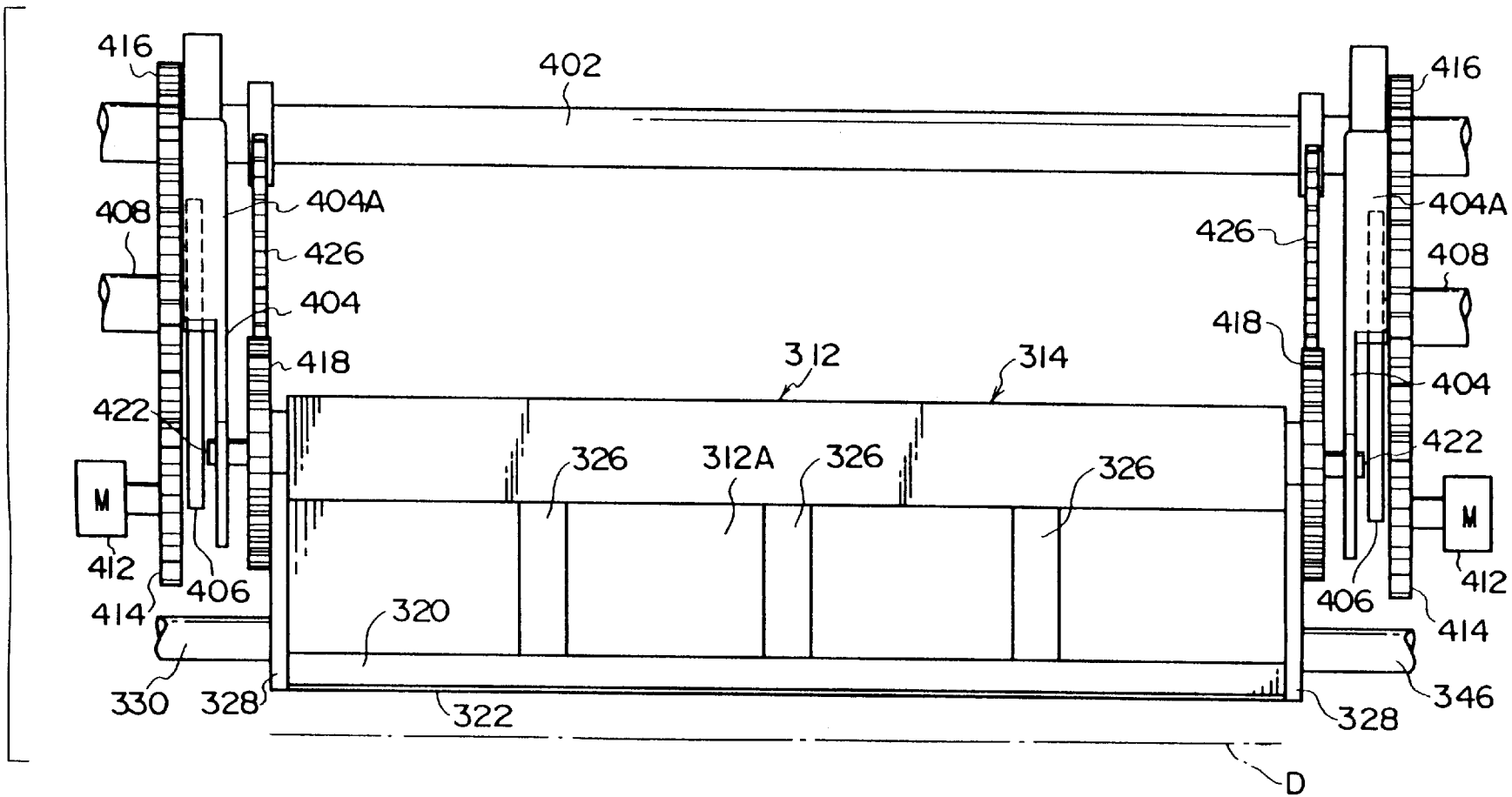
FIG. 4 is a view taken along a line 4—4 of FIG. 3.
Figure 5:
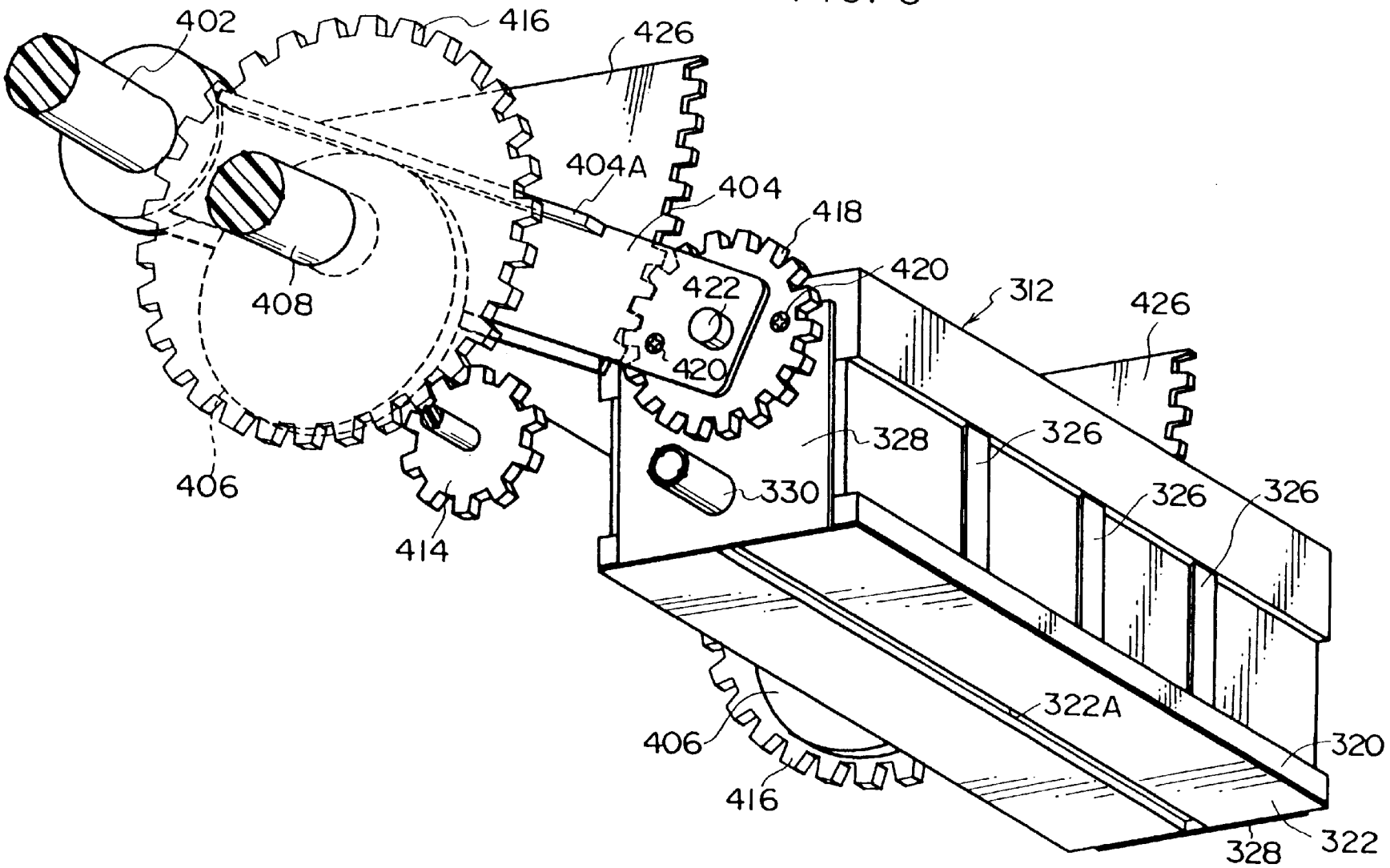
FIG. 5 is a perspective view of the jetting tank and the position-controlling mechanism according to the embodiment of the present invention.
Figure 6:
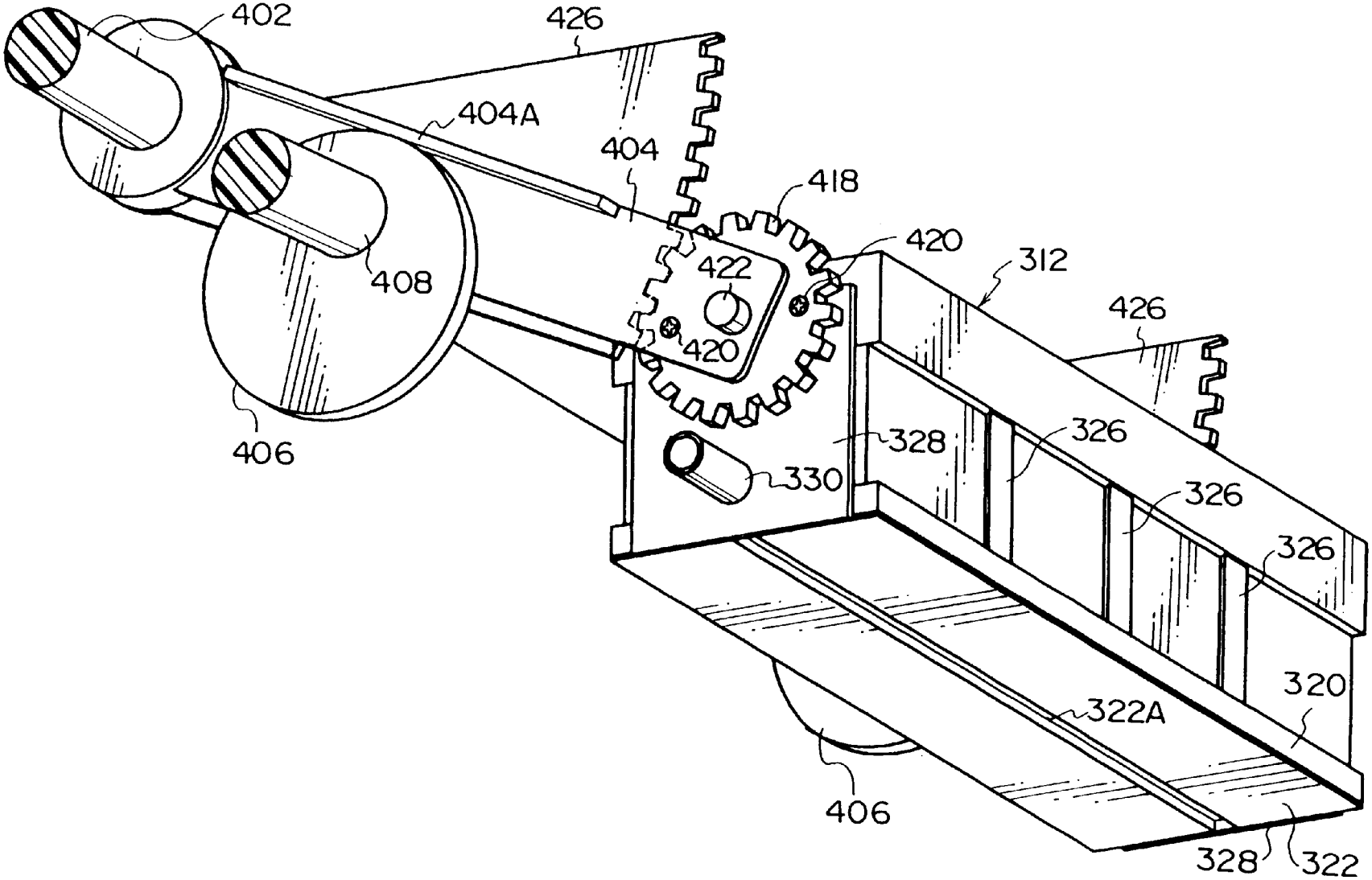
FIG. 6 is a perspective view of the jetting tank and the position-controlling mechanism according to the embodiment of the present invention, in which transmission gears and driving-side gears have been omitted.

On the other hand, as illustrated in FIGS. 2 and 4, an exhaust duct 330 extends upward from an end portion of the jetting tank 312, which end portion is at an opposite side of the portion to which the water-conveyance pipe 346 is connected. The exhaust duct 330 enables the inside and outside of the jetting tank 312 to be linked. Further, an unillustrated valve is set at an intermediate portion of the exhaust duct 330, for opening and closing the exhaust duct 330. The inside of the jetting tank 312 can be linked to or closed off from the outside air, due to opening and closing movements of this valve.

As illustrated in FIGS. 3 to 6, a swinging shaft 402, which extends along the longitudinal direction of the jetting tank 312, is embedded in the mount 12. Swinging arms 404, which are a pair of arms having end portions that are supported so as to be rotatable around the swinging shaft 402, are attached to the mount 12 via the swinging shaft 402.

Cross-sections of the pair of swinging arms 404 are each formed in a substantially L-shaped configuration, as shown in FIG. 4. A circular cam 406 is disposed at the lower side of an upper side 404A of each of the swinging arms 404, which upper side 404A forms an upper side of the respective swinging arm 404. The circular cams 406 are disposed so as to contact the respective upper sides 404A.

At an eccentric position with respect to a center line of each of the pair of the cams 406, an eccentric shaft 408 is disposed so as to be rotatably embedded in the mount 12. The pair of the cams 406 are fixed to sides of the pair of eccentric shafts 408, respectively. As a result, each of the pair of the cams 406 can rotate about the respective eccentric shaft 408 of the pair of eccentric shafts 408.

A transmission gear 416 is fixed at a side of the other end of each of the pair of the eccentric shafts 408, as illustrated in FIG. 4. A pair of driving-side gears 414, which are driven-rotated by motors 412 that act as sources of driving force, engages with the pair of the transmission gears 416, respectively. The cams 406 are rotated by the driving rotation of the pair of the motors 412, via the driving-side gears 414 and the transmission gears 416. Each of this pair of the motors 412 is connected to a controller, which controls rotation of the motors 412.

On the other hand, a pair of fixed gears 418 are fixed to two end portions of the jetting tank 312, respectively. Each of the fixed gears 418 is fixed by a pair of screws 420. A supporting shaft 422 protrudes from the center of each of the pair of the fixed gears 418. Each of the pair of the supporting shafts 422 protrudes from the centers of the fixed gears 418 and loosely meshes with the respective distal end side of the pair of swinging arms 404, so as to be rotatable.

Each respective center portion of fan-shaped sector gears 426 is fixed to the swinging shaft 402. The teeth of the pair of the sector gears 426 are provided in a circular-arc configuration, and respectively mesh with the pair of the fixed gears 418, each of which is fixed to an end portion of the jetting tank 312. Namely, this pair of the sector gears 426 forms a first gear whose teeth are arranged along an arc having as an axis a swinging axis P of the swinging arm 404. The pair of the fixed gears 418 forms a second gear which can change the position of the jetting tank 312 in conjunction with rotation of the jetting tank 312.

Accordingly, due to each of the pair of motors 412 being driven-rotated while being controlled by the controller, driving force is transmitted to the pair of the cams 406 via the driving-side gears 414 and the transmission gears 416. As a result, each of the pair of the cams 406 rotate about the respective eccentric shaft 408. An upper portion of the cam 406 contacts with the upper side 404A of the swinging arm 404, and the swinging arm 404 swings around the swinging shaft 402.

Then, in conjunction with the swinging of the swinging arms 404 while the sector gear 426 and the fixed gear 418 are meshed with each other, the jetting tank 312 is rotated. As a result, the jetting tank 312 rotates around the supporting shafts 422.

Figure 3:
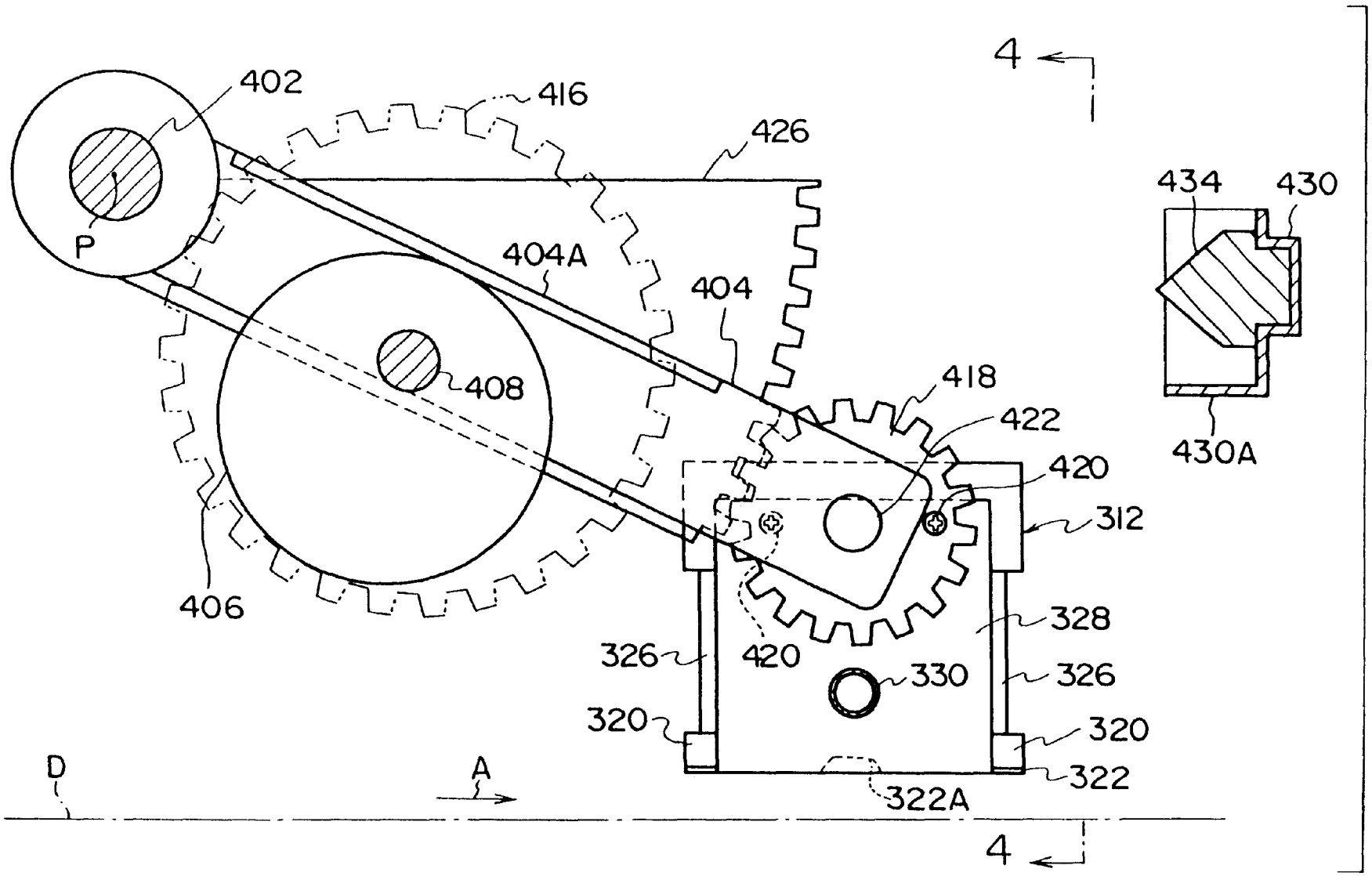
FIG. 3 is a side view of a jetting tank and the position-controlling mechanism during jetting, according to the embodiment of the present invention.

On the other hand, a bracket 430 made of rubber is disposed at a position that is towards the right in FIG. 3, by being fixed to the mount 12. A base end portion of a cleaning member 434 is supported by the bracket 430. The cleaning member 434 is formed in a sponge form, and can be easily deformed. Further, a protruding piece 430A made of rubber is formed at a lower end portion of the bracket 430. A distal end portion of the protruding piece 430A and a distal end of the cleaning member 434, which protrudes in a mountain shape, extend to substantially the same position in the left-right direction of FIG. 3.

Figure 7:
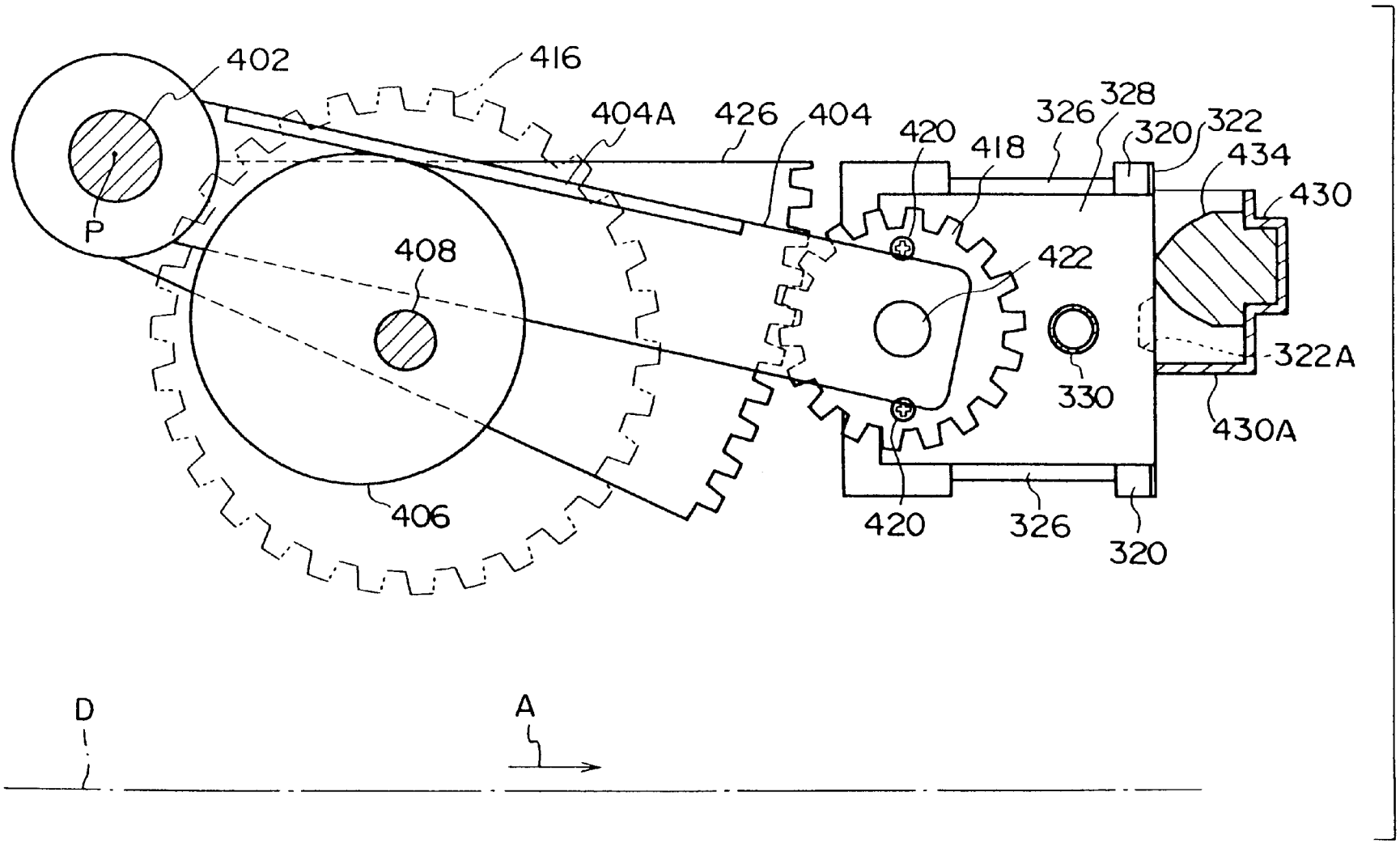
FIG. 7 is a side view of the jetting tank and the position-controlling mechanism in a standby state according to the embodiment of the present invention.

Accordingly, in FIG. 7, which illustrates a standby state of the jetting tank during the period until water is jetted onto the photosensitive material 16, the jetting tank 312 is disposed such that the nozzle holes 324 of the jetting tank 312 are positioned between the cleaning member 434 and the protruding piece 430A. A portion of the jetting surface having the plurality of the nozzle holes 324 is thereby sealed by the cleaning member 434 and the protruding piece 430A.

As a result, a driving mechanism which swings the swinging arms 404 is structured by the motors 412, the driving-side gears 414, the transmission gears 416, and the cams 406. A position-controlling mechanism which can change the position of the jetting tank 312 in accordance with the state of the jetting tank 312 is structured by the swinging arms 404, the sector gears 426, the fixed gears 418, and the driving mechanism.

Further, a sealing- and cleaning-member, which can seal the jetting surface of the jetting tank 312 and can clean the jetting surface, is structured by the protruding piece 430A of the bracket 430 and the cleaning member 434.

Figure 8:
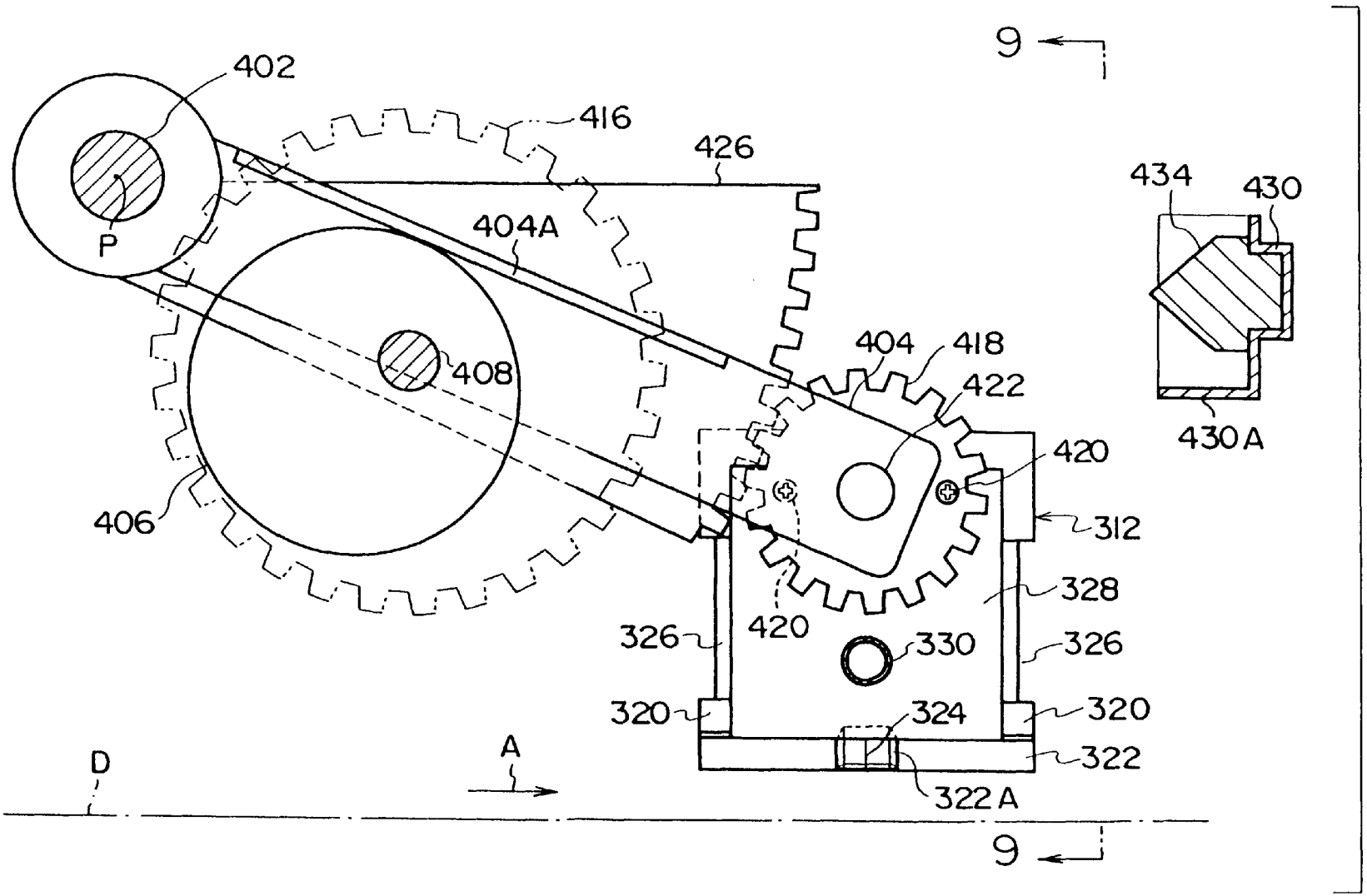
FIG. 8 is a side view of the jetting tank and the position-controlling mechanism in a charging-start state according to the embodiment of the present invention.
Figure 9:
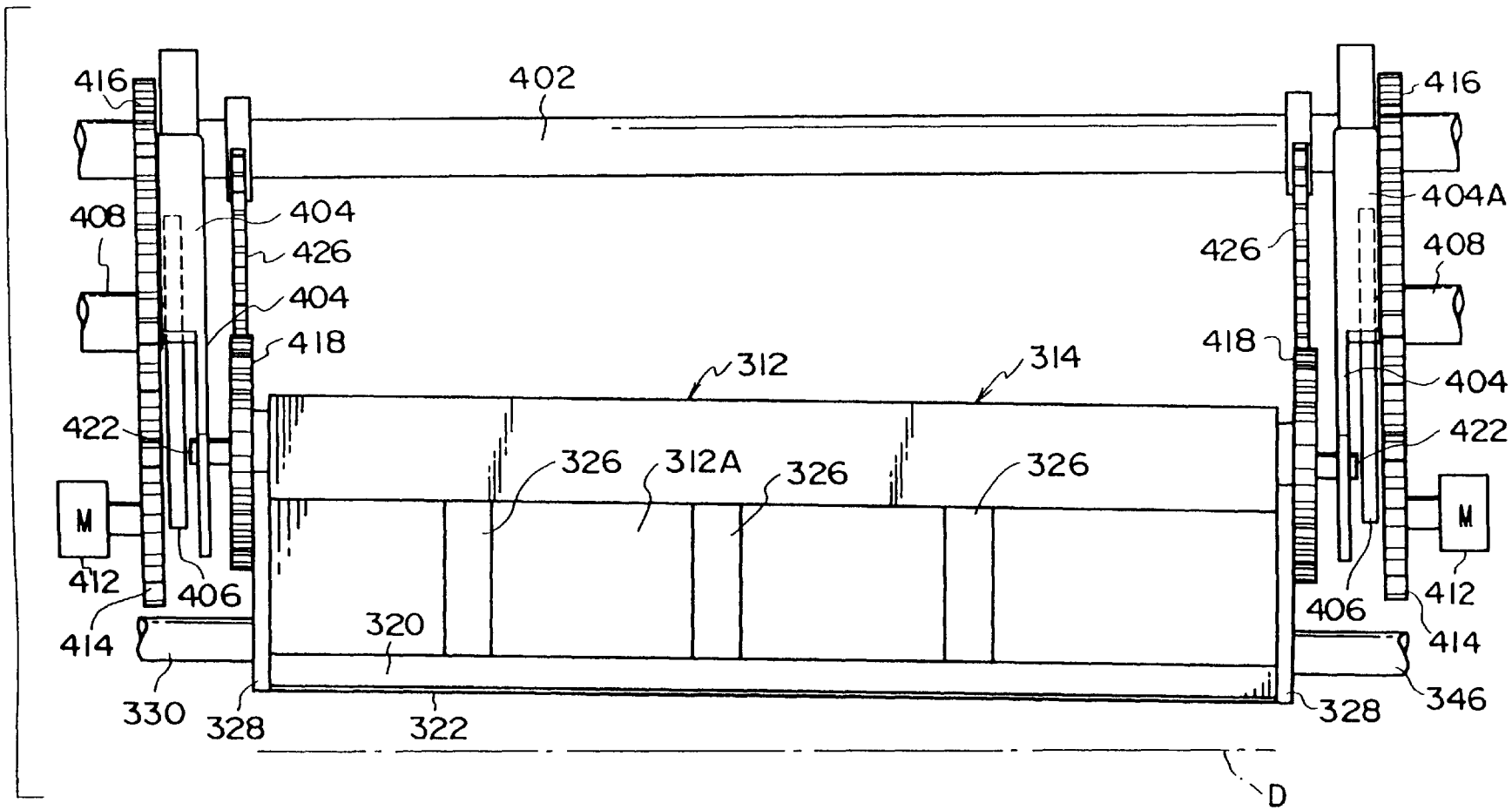
FIG. 9 is a view taken along a line 9—9 of FIG. 8.

Further, due to the presence of the controller, it is possible to incline the jetting tank 312 as illustrated in FIGS. 8 and 9, since the controller can control the number of rotations of each of the pair of the motors 412.

On the other hand, as illustrated in FIG. 13, both end portions of the nozzle plate 322, which are end portions located in the direction intersecting the longitudinal direction of a nozzle row formed with the plurality of the nozzle holes 324 arranged linearly, are adhered with an adhesive or the like to a pair of lever plates 320, respectively, which are deformation-transmitting members. By being adhered and connected in this way, the nozzle plate 322 and the pair of the lever plates 320 are connected. Each of the pair of the lever plates 320 are fixed to a side wall 312A, via a supporting portion 312B. Each of the supporting portions 312B has a small width, is formed at a lower portion of the respective side wall 312A, and extends along the direction the plurality of the nozzles holes 324 are arranged.

On the other hand, a pair of top walls 312C, which form the top surface of the jetting surface by abutting each other, protrude to the outside of the jetting tank 312. A plurality of piezoelectric elements 326, which serve as an actuator, are adhered to and disposed at respective lower sides of the protruding top walls 312C (in the present embodiment, each side has 3 piezoelectric elements). Outer end sides of the lever plates 320, which are portions of the lever plates exterior to the supporting portions 312B with respect to the nozzle plate 324, are adhered to respective lower surfaces of the piezoelectric elements 326. As a result, the piezoelectric elements 326 and the lever plates 320 are connected.

Accordingly, a lever mechanism is structured by the piezoelectric elements 326, the lever plates 320 and the supporting portions 312B. When the outer end sides of the lever plates 320 are moved due to the piezoelectric elements 326, the lever plates 320 swing about the supporting portions 312B, respectively, and inner end sides of the lever plates 320 move in the direction opposite to this movement. The piezoelectric elements 326 are formed with a laminated material such as laminated piezoelectric ceramic. As a result, deformation of the piezoelectric elements 326 in the axial direction is large. The piezoelectric elements 326 are connected to power sources (each of which are not shown), respectively. The timing with which the power sources apply voltage is controlled by the controller. The controller is also connected to the valve for opening and closing the exhaust duct 330. Thus, together with the power sources (not shown), the controller controls the opening and closing movements of the valve of the exhaust duct 330 as well.

On the other hand, each of the lever plates 320, the side walls 312A, the supporting portions 312B and the top walls 312C form a portion of an integrally formed frame 314. As illustrated in FIG. 13, due to the frames 314 being screwed down with bolts (not shown), the pair of the lever plates 320, the pair of the side walls 312A, the pair of the top walls 312C, and the pair of the supporting portions 312B, are each disposed such that respective members of the pairs face each other, and together form an outer frame of the jetting tank 312.

The frames 314 are formed with a metal material such as aluminum, brass, magnesium, or the like.

As a result of the above, the nozzle plate 322 can acquire a large, uniform amplitude along the direction along which the plurality of the nozzle holes 324 are arranged linearly, even with a small number of the piezoelectric elements 326. Thus, the amplitude distribution along the transverse direction of the photosensitive material 16 is even, and an amplitude can be obtained that can produce pressure such that the water pressure at portions peripheral to each of the nozzle holes 324 enables atomization. As a result, water can be jetted and atomized from the plurality of the nozzle holes 324 along the entire transverse direction of the photosensitive material 16 in a substantially uniform manner.

As illustrated in FIG. 11, at each of portions framed by the left and right ends of the nozzle plate 322, which are end portions of the nozzle plate 322 located in the longitudinal direction of the nozzle row formed by the nozzle holes 324, and by end portions of the pair of the frames 314, respectively, a thin-walled sealing plate 328 is disposed so as to adhere to the respective frame 314.

At inner sides of the sealing plates 328, a deformable adhesive that is a silicon rubber-type is filled into the openings between the sealing plates 328, the left and right ends of the nozzle plate 322 and the end portions of the pair of the frames 314, in order to prevent water from leaking therefrom. Accordingly, the openings of the jetting tank 312 are sealed by the deformable adhesive, without inhibiting the movement of the left and right ends of the nozzle plate 322. It is also possible to seal the left and right ends of the jetting tank 312 using only the deformable adhesive, without using the thin-walled sealing plates 328.

Figure 14:
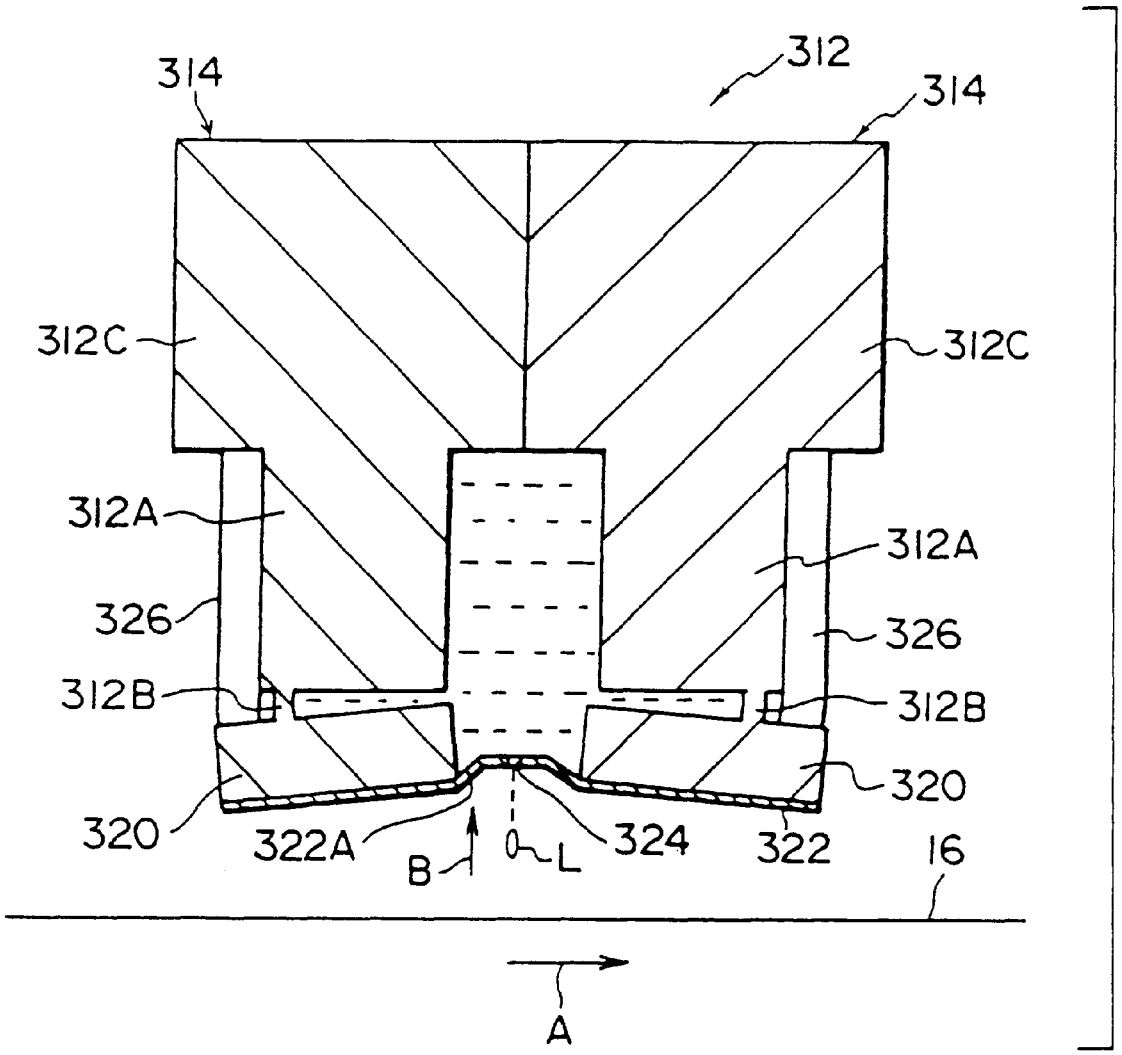
FIG. 14 is a cross-sectional view of the jetting tank in a state in which water is being jetted therefrom in the embodiment according to the present invention.

Due to the above, when the piezoelectric elements 326 are energized by the power source, the piezoelectric elements 326 lengthen and the lever plates 320 rotate about the supporting portions 312B, as illustrated in FIG. 14. Together with this rotation, the piezoelectric elements 326 simultaneously deform and displace the nozzle plates 322 so that an intermediate portion of the nozzles plate 322 rises along the direction of arrow B via the lever plates 320. Together with the deformation of the nozzle plates 322, the water pressure inside the jetting tank 312 rises, a batch of water droplets L, which are small amounts of water from the nozzle holes 324, are jetted such that each of the water droplets L are jetted linearly.

By repeatedly energizing the piezoelectric elements 326 and thereby lengthening the piezoelectric elements 326 repeatedly, the water droplets L can be jetted from the nozzle holes 324 successively.

On the other hand, as illustrated in FIG. 1, an image-receiving material magazine 106 for storing an image-receiving material 108 is disposed at upper left end portion inside the mount 12. A dye fixing material containing a mordant is applied to an image-forming surface of the image-receiving material 108. The image-receiving material 108 is wound in a roll configuration at the image-receiving material magazine 106 such that when the image-receiving material 108 is pulled out from the image-receiving material magazine 106, the image-forming surface of the image-receiving material 108 faces downward. Nip rollers 110 are disposed at a vicinity of an image-receiving material pull-out opening of the image-receiving material magazine 106. The nip rollers 110 can nip the image-receiving material 108 and pull the image-receiving material 108 from the image-receiving material magazine 106. The nip rollers 110 can also release the nipping of the image-receiving material 108.

A cutter 112 is disposed at a side of the nip rollers 110. In the same way as the cutter 20 for the photosensitive material, the cutter 112 is a rotary type comprised of a fixed blade and a movable blade, for example. Thus, by moving the movable blade up and down with a rotary cam or the like, thereby causing the movable blade to engage with the fixed blade, the image-receiving material 108, which has been drawn out from the image-receiving material magazine 106, can be cut into a length shorter than that of the photosensitive material 16.

Conveying rollers 132, 134, 136, 138 and an unillustrated guide plate are disposed at a side of the cutter 112. The image-receiving material 108, which has been cut into a prescribed length, can be conveyed toward a thermal development transfer section 120 with the conveying rollers 132, 134, 136, 138 and the guide plate.

Figure 17:
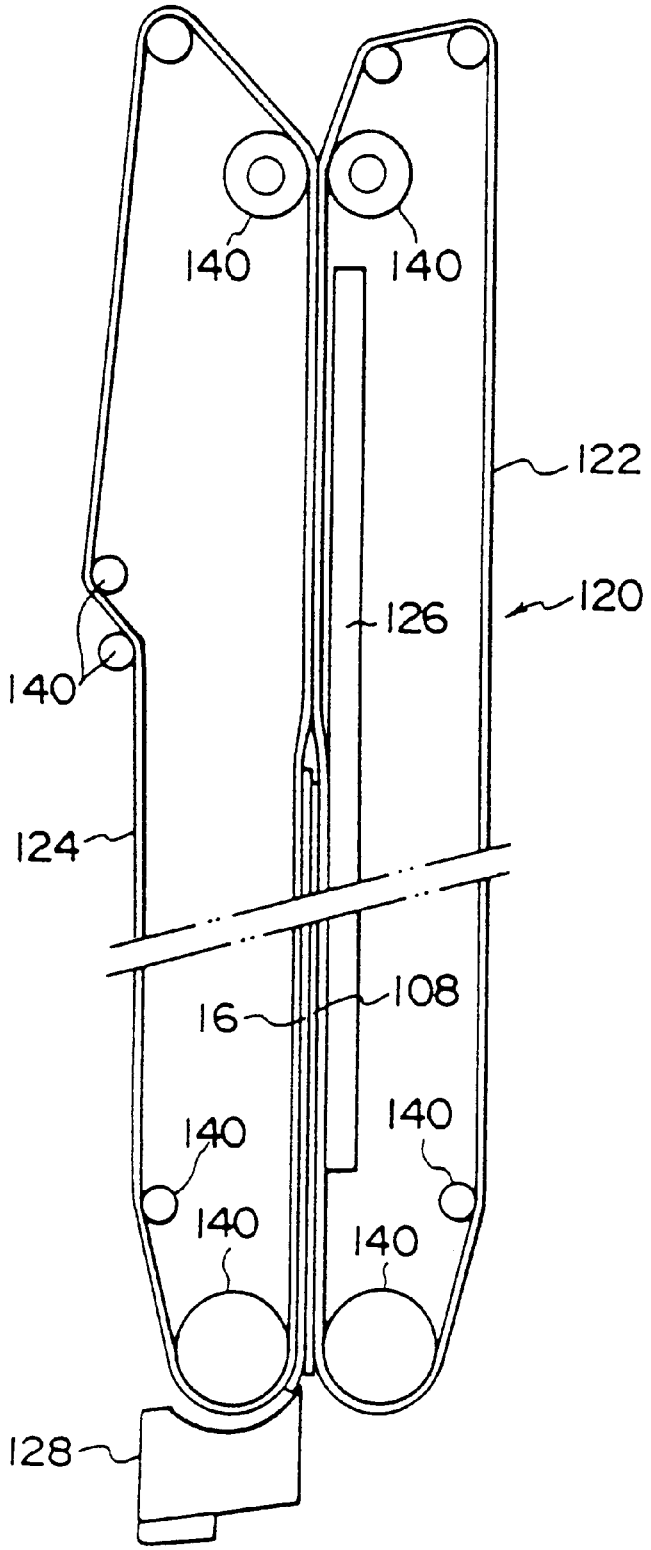
FIG. 17 is an enlarged view of a thermal development transfer section in the embodiment according to the present invention.

As illustrated in FIGS. 1 and 17, the thermal development transfer section 120 includes a pair of endless belts 122, 124 which are each in a loop configuration having the up/down direction as the longitudinal direction thereof. The pair of the endless belts 122, 124 are entrained around a plurality of entraining rollers 140. Accordingly, when one of these entraining rollers 140 are driven-rotated, each of the pair of the endless belts 122, 124 entrained around the entraining rollers 140 is rotated.

Inside the loop of the endless belt 122, which is the belt on the right in the Figures among the pair of the endless belts 122, 124, a heating plate 126, which is formed in a flat plate-like form having the up/down direction as the longitudinal direction thereof, is disposed so as to face an inner circumferential portion of the left side of the endless belt 122. A heater having a line configuration (not shown) is disposed at an inner portion of the heating plate 126. Due to this heater, the temperature of the surface of the heating plate 126 can be raised, to a predetermined temperature.

Accordingly, the photosensitive material 16 is conveyed to between the pair of the endless belts 122, 124 of the thermal development transfer section 120, by the final conveying rollers 34 of the transporting path. Further, the image-receiving material 108 is conveyed during the same period the photosensitive material 16 is conveyed. The image-receiving material 108 is conveyed by the conveying rollers 138, which are the last conveying rollers of the transporting path, to between the pair of the endless belts 122, 124 of the thermal development transfer section 120, with the photosensitive material 16 preceding the image-receiving material 108 by a predetermined length. The image-receiving material 108 is then laminated onto the photosensitive material 16.

In this case, lamination is effected in a state wherein all four edge portions of the photosensitive material 16 protrude from the edge portions of the image-receiving material 108, since the dimensions of the image-receiving material 108 in the transverse and longitudinal directions are all shorter than that of the photosensitive material 16.

As a result of the above, the photosensitive material 16 and the image-receiving material 108, which have been laminated together by the pair of the endless belts 122, 124, are conveyed in an interposed state by the pair of the endless belts 122, 124 while remaining in the laminated state. When the photosensitive material 16 and the image-receiving material 108, which have been laminated together, are positioned completely between the pair of the endless belts 122, 124, rotation of the pair of the endless belts 122, 124 is temporarily stopped, and the interposed photosensitive material 16 and the image-receiving material 108 are heated with the heating plate 126. The photosensitive material 16 is heated via the heating plate and the endless belt 122 while being conveyed in an interposed state and while the conveyance is stopped. In conjunction with the heating, mobile dyes are discharged, these dyes are transferred during this time to a dye-fixing layer of the image-receiving material 108, and an image is thereby obtained on the image-receiving material 108.

Further, at a side downstream of the pair of the endless belts 122, 124 in the direction the materials are conveyed, a stripping finger 128 is disposed. The stripping finger 128 engages with only a leading end portion of the photosensitive material among the photosensitive material 16 and the image-receiving material 108 which are conveyed in an interposed state between the pair of the endless belts 122, 124. The leading end portion of the photosensitive material 16, which protrudes from the pair of the endless belts 122, 124, is peeled away from the image-receiving material 108.

Photosensitive material discharging rollers 148 are disposed at the left of the stripping finger 128. The photosensitive material 16, which is moved to the left while being guided by the stripping finger 128, can be conveyed toward a waste photosensitive material storage section 150.

The waste photosensitive material storage section 150 comprises a drum 152 upon which the photosensitive material 16 is entrained, and a belt 154, a portion of which is entrained on the drum 152. Further, the belt 154 is entrained between a plurality of rollers 156. Due to the rotation of these rollers 156, the belt 153 is rotated, and the drum 152 rotates in conjunction.

Accordingly, when the photosensitive material 16 is conveyed in a state in which the belt 154 is rotated by the rotation of the rollers 156, the photosensitive material 16 can accumulate around the drum 152.

On the other hand, as shown in FIG. 1, image-receiving material discharging rollers 162, 164, 166, 168, 170 are disposed such that the image-receiving material 108 can be conveyed from a lower side of the pair of the endless belts 122, 124 towards the left. Thus, the image-receiving material 108 which has been discharged from the pair of the endless belts 122, 124, is conveyed by the image-receiving material discharging rollers 162, 164, 166, 170, and is discharged into a tray 172.

Next, operation of the present embodiment will be explained.

In the image recording apparatus 10 having the structure described above, after the photosensitive material magazine 14 is set, the nip rollers 18 operate, and the photosensitive material 16 is pulled out by the nip rollers 18. After the photosensitive material 16 is pulled out the predetermined length, the cutter 20 operates. The photosensitive material 16 is cut into a predetermined length, and is conveyed to the exposing section 22 with the photosensitive (exposure) surface facing left. The exposure device 38 operates while the photosensitive material 16 passes through the exposing section 22, and the photosensitive material 16 positioned at the exposing section 22 has an image formed thereon through scan exposure.

After exposure is completed, the photosensitive material 16 which has been exposed is sent to the water application section 50. At the water application section 50, the conveyed photosensitive material 16 is conveyed toward the jetting tank 312 by the conveying rollers 32 being driven, as illustrated in FIG. 11.

Water is attached to the photosensitive material 16, which is conveyed along the transporting path D, due to the jetting tank 312 jetting water. Operation and movements at this time are explained below.

First, the position of the jetting tank 312, which is in a standby state illustrated in FIG. 7, is changed, and the photosensitive material 16 is disposed so as to face the transporting path D. The jetting tank 312, which stores water charged therein, jets water towards the photosensitive material 16. The conveying rollers 34, which are disposed downstream of the jetting tank 312 on the transporting path D for the photosensitive material 16, convey further the photosensitive material 16 upon which water has been jetted.

At this time, the swinging arms 404, which support the jetting tank, are swung by the cams 406, which are rotated by the motors 412. In conjunction, the jetting tank 312 rotates. At this time, the sector gears 426, each of whose teeth are arranged along an arc having as a center a swinging center point P of the swinging arm 404, mesh together with the fixed gears 418, which are fixed at the jetting tank 312, and the jetting tank 312 simultaneously undergoes rotation. In conjunction with the swinging of the swinging arms 404, the jetting tank 312 rotates, and the position thereof changes.

Figure 10:
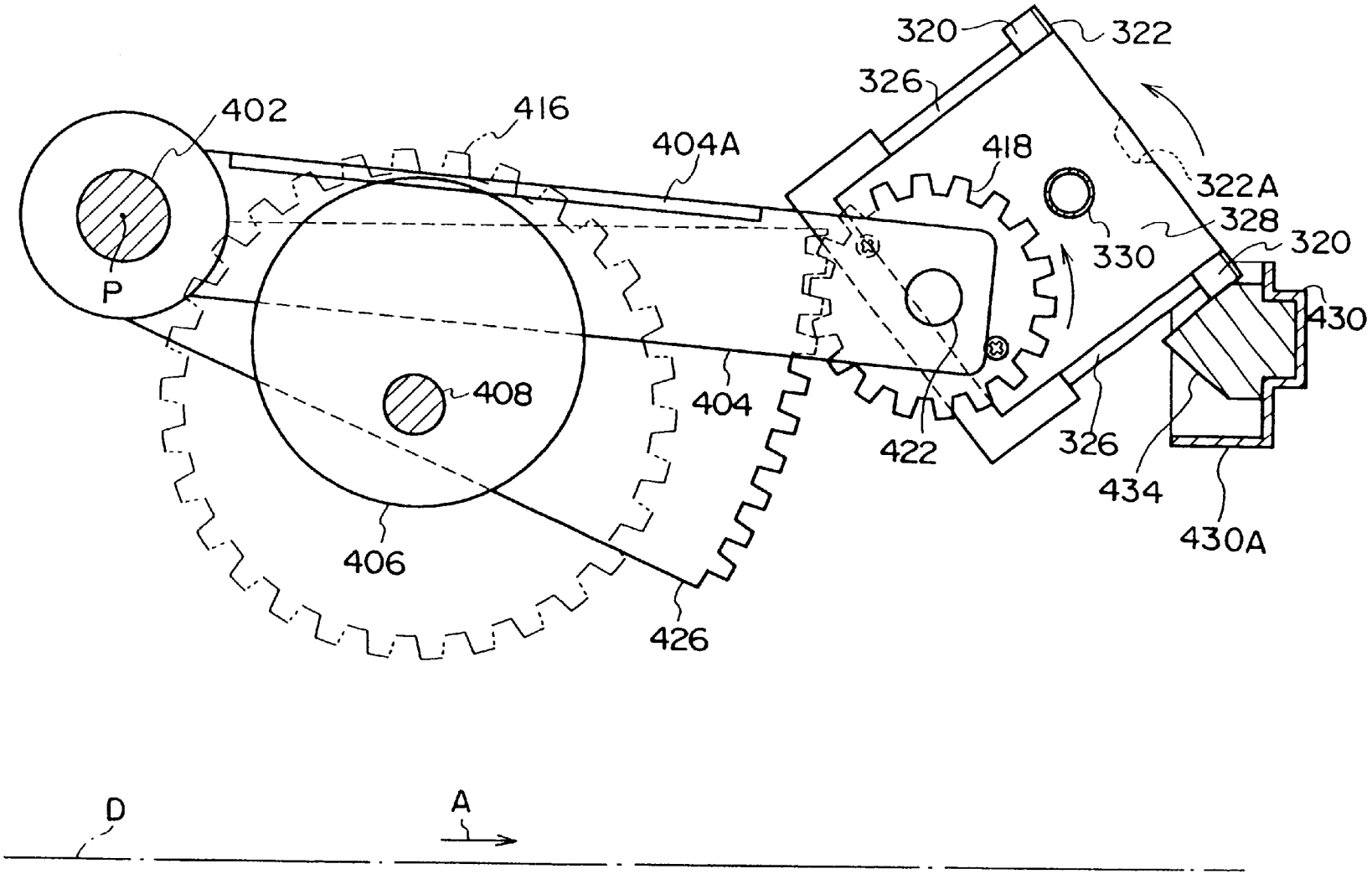
FIG. 10 is a side view illustrating further rotation of the jetting tank and the position-controlling mechanism according to the embodiment of the present invention.

Namely, the jetting tank 312 can be placed in the following states: the standby state which is until water is jetted onto the photosensitive material 16 and which is illustrated in FIG. 7; a charging-start state in which charging of water into the jetting tank 312 begins and which is illustrated in FIGS. 8 and 9; a jetting state in which water is jetted towards the photosensitive material 16 and which is illustrated in FIGS. 3 and 4; a cleaning state in which the jetting surface of the jetting tank 312 is cleaned with a distal end of the cleaning member 434 by further rotating the jetting tank 312 from the position indicated in FIG. 7 to the position indicated in FIG. 10, and the like. In accordance with each of the states of the jetting tank 312, the position of the jetting tank 312 is changed by the position-controlling mechanism structured by the motors 412, the driving-side gears 414, the cams 406, the swinging arms 404, the sector gears 426, and the fixed gears 418.

Accordingly, the position of the jetting tank 312 can be changed by the position-controlling mechanism in accordance with each of the states of the jetting tank 312. Thus, when water begins to be charged via the water-conveyance pipe 346, the position of the jetting tank 312 is changed while having each of the pair of the motors 412 have different numbers of rotations from each other, and the jetting tank 312 is inclined as illustrated in FIGS. 8 and 9. As a result, the air inside the jetting tank 312 is easily discharged from the exhaust duct 330, and residual air inside the jetting tank 312 disappears. Further, by changing the position of the jetting tank 312 from the position illustrated in FIG. 7 to the position shown in FIG. 10 so as to change the position of the jetting tank 312 to beyond the position where the cleaning member 434 is present, the jetting surface of the jetting tank 312 can be easily cleaned with the cleaning member 434. As a result, water can be jetted towards the photosensitive material 16 reliably whenever necessary.

Further, when discharging water from inside the jetting tank 312, water can be more reliably discharged from inside the jetting tank 312 by having the jetting tank 312 assume the same position as the charging-start state illustrated in FIGS. 8 and 9.

On the other hand, water can be prevented from inadvertently spilling or evaporating from the jetting tank 312 by changing the position of the jetting tank 312 to the position shown in FIG. 7, in which the sealing- and cleaning-member serving as a cap is present, thereby sealing the jetting surface.

Further, because the position of the jetting tank 312 can be changed, the photosensitive material 16 can be easily removed from the transporting path D when during conveyance, the photosensitive material 16 becomes jammed at a portion of the transporting path D facing the jetting tank 312.

When the position of the jetting tank 312 is changed from the jetting state shown in FIGS. 3 and 4 to the standby state shown in FIG. 7 as described above, the protruding piece 430A and the cleaning member 434, which form the sealing- and cleaning-member, seal the jetting surface from which water of the jetting tank 312 is jetted. By rotating the jetting tank 312 further to the position shown in FIG. 10, the jetting surface can be cleaned by the cleaning member 434.

Accordingly, in the standby state and the cleaning state, which are non-jetting states, the sealing- and cleaning-member seals the jetting surface from which water of the jetting tank 312 is jetted, and cleans the jetting surface, respectively. Thus, the number of components of the image recording apparatus 10 can be reduced.

Further, the heating plate 356 is disposed between the jetting tank 312 and the conveying rollers 34, at a side opposite to the jetting tank 312, with the transporting path D for the photosensitive material 16 therebetween. The photosensitive material 16 is attracted with the suction holes 358 of the heating plate 356, is heated while on the transporting path D by the heating plate 356, and is conveyed while being guided by the heating plate 356.

Figure 16:
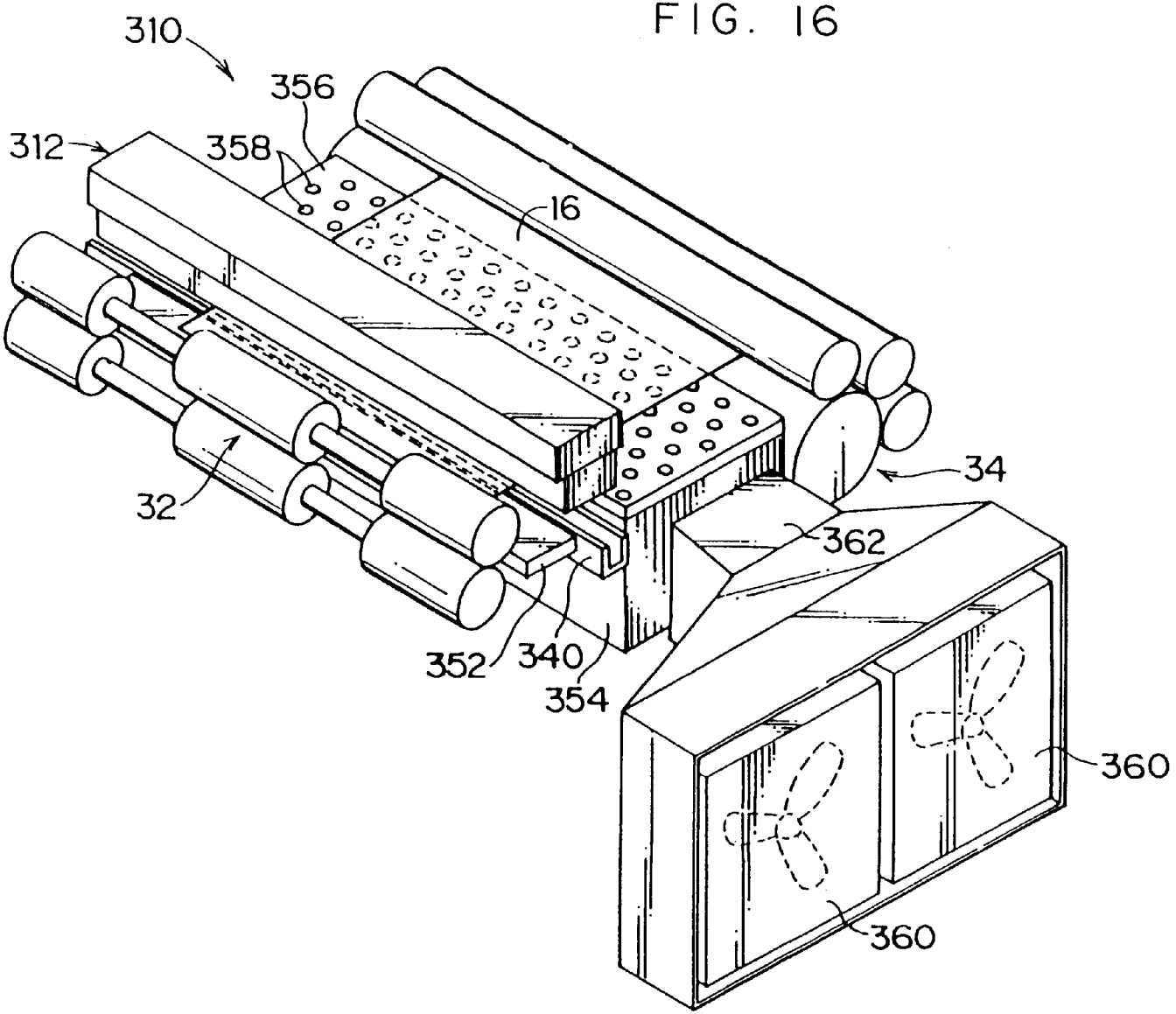
FIG. 16 is a perspective view of the application device in a state in which the photosensitive material is being heated in the embodiment according to the present invention (however, the position-controlling mechanism has been omitted from the Figure).

Specifically, the photosensitive material 16 is conveyed on the transporting path D with the conveying rollers 32 shown in FIGS. 2 and 15, and even after water attaches to the leading end side of the photosensitive material 16 by being jetted by the jetting tank 312, the photosensitive material 16 is conveyed while sliding along the top of the heating plate 356. Next, as illustrated in FIG. 16, when the leading end side of the photosensitive material 16 is nipped by the conveying rollers 34, the conveyance of the photosensitive material 16 is stopped for only a number of seconds, for example, to heat the photosensitive material 16 with the heating plate 356.

Thereafter, the conveyance of the photosensitive material 16 is restarted using the conveying rollers 34, and the photosensitive material 16 is conveyed off of the top of the heating plate 356.

The heating plate 356 attracts the photosensitive material 16 through the suction holes 358, thereby guiding the photosensitive material 16 in a state where the photosensitive material 16 closely contacts the heating plate 356 while sliding along the top thereof. As a result, when the jetting tank 312 jets water, a clearance K (see FIG. 13) between the jetting tank 312 and the photosensitive material 16 is constantly maintained. Thus, portions to which water is not attached on the photosensitive material 16 are not formed, and water can be evenly applied to the photosensitive material 16.

Namely, in cases where the predetermined clearance K cannot be maintained due to the photosensitive material 16 curling or the like, the photosensitive material 16 becomes too close or too far removed with respect to the jetting tank 312, and there is the fear that the water may become attached in a nonuniform manner. However, since the clearance K is constantly maintained, water can be evenly applied to the top of the photosensitive material 16.

Initially, before jetting water with the jetting tank 312, the valve of the exhaust duct 330 is placed in a closed state by the controller. In this state, while jetting and simultaneously atomizing the water, voltage is applied to the piezoelectric elements 326 by energizing with the power source controlled by the controller, and all of the piezoelectric elements 326 are simultaneously deformed so as to lengthen.

Together with the movement of the piezoelectric elements 326, the water that has been charged into the jetting tank 312 is jetted from the plurality of the nozzle holes 324. As a result, the water charged into the jetting tank 312 can be jetted and simultaneously atomized from the nozzle holes 324 to be attached to the top of the photosensitive material 16 which is being conveyed, as shown in FIG. 14.

At this time, together with the movement of the piezoelectric elements 326, the portion of the nozzle plate 322 at which the plurality of the nozzle holes 324 is provided is displaced uniformly as a whole, because the lever plates 320 swing about the supporting portions 312B, which extend along the direction the plurality of the nozzle holes 324 are linearly arranged. As a result, the nozzles holes 324 can be stably displaced such that the entirety thereof is displaced the same amount at the same time, along the longitudinal direction of the nozzle row formed by the plurality of the nozzle holes arranged linearly. The water charged into the jetting tank 312 is thereby evenly jetted from the plurality of the nozzle holes 324. Accordingly, it becomes even more difficult for portions without water attached thereto to form on the photosensitive material 16.

On the other hand, the jetting tank 312 includes the nozzle holes 324, and water is jetted from these nozzle holes 324. As a result, water can be applied using a small amount of water in comparison with an application device which applies water by storing water in a vat and soaking a photosensitive material therein. Moreover, the photosensitive material 16 can be dried in a short amount of time.

The jetting tank 312 includes the plurality of the nozzle holes 324 which are disposed along the entire transverse direction of the photosensitive material 16, and water is jetted from the nozzle holes 324 at the same time by a single displacement caused by the piezoelectric elements 326. Thus, by a single instance of jetting, water can be applied in a wide range across the entire transverse direction of the photosensitive material 16. As a result, it is not necessary to slide the nozzle plate 322 along a two-dimensional plane, and water can be applied to a large surface area in a short amount of time. The amount of time for application can thereby be reduced.

By jetting the water from the nozzle holes 324 a plurality of times at a chosen timing in correspondence with the speed at which the photosensitive material 16 is conveyed, water is applied to the entire surface of the photosensitive material 16. When water is jetted from the nozzle holes 324 of the nozzle plate 322, the water inside the jetting tank 312 decreases in proper course. However, a function is included in which the water level inside the jetting tank 312 is fixed by the sub-tank 338 supplying water. Thus, water is supplied from the sub-tank 338 side and the water pressure inside the jetting tank 312 during atomization can be maintained at a fixed value, to ensure that the water can be jetted continuously.

Thereafter, the photosensitive material 16 to which water as the image-forming solvent has been applied in the water application section 50 is conveyed to between the pair of the endless belts 122, 124 of the thermal development transfer section 120, by the conveying rollers 34.

In conjunction with the photosensitive material 16 undergoing scan exposure, the image-receiving material 108 is pulled out by the nip rollers 110 from the image-receiving material magazine 106 and is thereby conveyed. When the image-receiving material 108 is pulled out a predetermined length, the cutter 112 operates to cut the image-receiving material 108 into a predetermined length.

After operation of the cutter 112, the image-receiving material 108 which has been cut is conveyed by the conveying rollers 132, 134, 136, 138 while being guided by the guide plate. When the leading end portion of the image-receiving material 108 is nipped by the conveying rollers 138, the image-receiving material 108 assumes the standby state at a position just before the thermal development transfer section 120.

As described above, in conjunction with the photosensitive material 16 being conveyed to between the pair of the endless belts 122, 124 by the conveying rollers 34 as described above, conveyance of the image-receiving material 108 is restarted, and the image-receiving material 108 and the photosensitive material 16 are conveyed to between the pair of the endless belts 122, 124 in an integral state.

As a result, the photosensitive material 16 and the image-receiving material 108 are laminated together, and the photosensitive material 16 and the image-receiving material 108 are conveyed in an interposed state while being heated by the heating plate 126, to carry out thereby thermal development transfer to form an image on the image-receiving material 108.

Further, when the photosensitive material 16 and the image-receiving material 108 are discharged from the pair of the endless belts 122, 124, the stripping finger 128 engages with the leading end portion of the photosensitive material 16 which is conveyed so as to precede the image-receiving material 108 by a predetermined length. Thus, the leading end portion of the photosensitive material 16 is peeled away from the image-receiving material 108. The photosensitive material 16 is conveyed further by the photosensitive material discharging rollers 148 and accumulates within the waste photosensitive material storage section 150. At this time, the photosensitive material 16 dries quickly, and so additionally providing a heating device to dry the photosensitive material is not necessary.

On the other hand, the image-receiving material 108 which has been separated from the photosensitive material 16 is conveyed by the image-receiving material discharging rollers 162, 164, 166, 168, 170, and is discharged into the tray 172.

In cases in which image-recording processing is effected for a plurality of sheets, the above processes are carried out in proper course successively.

In this way, the image-receiving material 108, which has been subjected to thermal development transfer processing while interposed between the pair of the endless belts 122, 124 to thereby form (record) a predetermined image, is discharged from the pair of the endless belts 122, 124. Thereafter, the image-receiving material 108 is conveyed in an interposed state by the plurality of the image-receiving material discharging rollers 162, 164, 166, 168, 170 to be ejected out of the apparatus.

Further, in the present embodiment, rotational force is transmitted to the cams 406 from the motors 412 via the driving-side gears 414 and the transmission gears 416, but a structure may be adopted wherein cams are directly driven-rotated by motors.

Further, in the present embodiment the nozzle row is a single row. However, the nozzle row is not limited to being a single row, and two or more rows are also possible. By increasing the number of nozzle rows, the number of driving frequencies sent by the actuator can be reduced further. Further, in the present embodiment, the nozzle row is disposed orthogonally with respect to the conveying direction. However, the structure is not limited to the nozzle row being disposed orthogonally; the nozzle row may be disposed so as to be inclined with respect to the conveying direction.

Further, in the present embodiment, a structure is adopted wherein the photosensitive material 16 and the image-receiving material 108 are used as the image recording material, the photosensitive material 16 is exposed, water is applied to the exposed photosensitive material 16 by the jetting tank 312 of the application device 310, the photosensitive material 16 and the image-receiving material 108 are laminated together, and thermal development transfer is carried out. However, the present invention is not limited as such; water may be jetted and applied onto the image-receiving material 108.

Further, the materials are not limited to those described above; an image recording material of a sheet configuration or a roll configuration may also be applied, and the image-forming solvent may be a material other than water. Further, the present invention may be applied to: application of a developer onto a printing paper in a developing machine; application of water for soaking in a printing machine; a coater, and the like.

The image forming apparatus according to the present invention as described above produces excellent effects, namely, preventing the image-forming solvent from spilling out inadvertently, making possible reliable jetting of the image-forming solvent, and allowing easy removal of the photosensitive material when it becomes jammed on the transporting path.

What is claimed is:

1. An image forming apparatus, comprising:

a jetting device which is disposed so as to face a transporting path for an image recording material and which jets an image-forming solvent towards the image recording material; and a position-controlling mechanism which changes a position of the jetting device in correspondence with a state of the jetting device.

2. An image forming apparatus according to claim 1, wherein the position-controlling mechanism includes an arm, a first gear, a second gear, and a driving mechanism which swings the arm.

3. An image forming apparatus according to claim 1, wherein the image-forming solvent is water.

4. An image forming apparatus according to claim 1, wherein the jetting device includes a jetting tank, a nozzle section having a plurality of nozzle holes, an exhaust duct, and a lever plate.

5. An image forming apparatus according to claim 2, wherein the driving mechanism includes a plurality of motors, a first gear, a second gear, a cam, and a controller controlling each of the motors.

6. An image forming apparatus according to claim 2, wherein the driving mechanism includes a plurality of motors, a cam, and a controller controlling each of the motors.

7. An image forming apparatus according to claim 2, wherein the jetting device includes a jetting tank, a nozzle section having a plurality of nozzle holes, an exhaust duct, and a lever plate.

8. An image forming apparatus, comprising:

a jetting device which is disposed so as to face a transporting path for an image recording material and which jets an image-forming solvent towards the image recording material;

an arm which supports the jetting device and which swings to rotate the jetting device;

a first gear having teeth arranged along an arc having as a center thereof a swinging center point of the arm;

a second gear which is fixed at the jetting device so as to mesh with the first gear, and which changes a position of the jetting device in conjunction with rotation of the jetting device; and a driving mechanism which swings the arm.

9. An image forming apparatus according to claim 8, wherein the driving mechanism includes a plurality of motors, a first gear, a second gear, a cam, and a controller controlling each of the motors.

10. An image forming apparatus according to claim 8, wherein the driving mechanism includes a plurality of motors, a cam, and a controller controlling each of the motors.

11. An image forming apparatus according to claim 8, wherein the image-forming solvent is water.

12. An image forming apparatus according to claim 8, wherein the jetting device includes a jetting tank, a nozzle section having a plurality of nozzle holes, an exhaust duct, and a lever plate.

13. An image forming apparatus, comprising:

a jetting device which is disposed so as to face a transporting path for an image recording material and which jets an image-forming solvent towards the image recording material;

a position-controlling mechanism which changes a position of the jetting device in correspondence with a state of the jetting device; and a sealing- and cleaning-member which (1) seals a jetting surface of the jetting device and (2) cleans the jetting surface, when the jetting device is in a non-jetting state during which the jetting surface is not jetting the image-forming solvent.

14. An image forming apparatus according to claim 13, wherein the position-controlling mechanism includes an arm, a first gear, a second gear, and a driving mechanism which swings the arm.

15. An image forming apparatus according to claim 13, wherein the sealing- and cleaning-member includes a protruding piece of a bracket and a cleaning member.

16. An image forming apparatus according to claim 13, wherein the image-forming solvent is water.

17. An image forming apparatus according to claim 13, wherein the jetting device includes a jetting tank, a nozzle section having a plurality of nozzle holes, an exhaust duct, and a lever plate.

18. An image forming apparatus according to claim 14, wherein the driving mechanism includes a plurality of motors, a first gear, a second gear, a cam, and a controller controlling each of the motors.

19. An image forming apparatus according to claim 14, wherein the driving mechanism includes a plurality of motors, a cam, and a controller controlling each of the motors.

20. An image forming apparatus according to claim 14, wherein the jetting device includes a jetting tank, a nozzle section having a plurality of nozzle holes, an exhaust duct, and a lever plate.

* * * * *